US010890316B2

(12) United States Patent
Fisher et al.

(10) Patent No.: US 10,890,316 B2
(45) **Date of Patent: *Jan. 12, 2021**

(54) LIGHTING FIXTURE WITH HIGH STRUCTURAL INTEGRITY

(71) Applicant: IDEAL Industries Lighting LLC, Sycamore, IL (US)

(72) Inventors: Scott Fisher, Raleigh, NC (US); Jeremy Sorenson, Oak Creek, WI (US); Brad Thomas, Cary, NC (US); Kurt S. Wilcox, Libertyville, IL (US); John Roberts, Durham, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/578,531

(22) Filed: Sep. 23, 2019

(65) Prior Publication Data

US 2020/0018464 A1 Jan. 16, 2020

Related U.S. Application Data

(63) Continuation of application No. 15/477,435, filed on Apr. 3, 2017, now Pat. No. 10,473,308.

(51) Int. Cl.

| | |
|---|---|
| ***F21S 8/08*** | (2006.01) |
| ***F21V 21/116*** | (2006.01) |
| *F21V 15/01* | (2006.01) |
| *F21V 21/14* | (2006.01) |
| *F21W 131/10* | (2006.01) |

(52) U.S. Cl.

CPC ..... *F21V 21/116* (2013.01); *F21S 8/086* (2013.01); *F21V 15/01* (2013.01); *F21V 21/14* (2013.01); *F21W 2131/10* (2013.01)

(58) Field of Classification Search

CPC ..... F21S 8/086; F21V 21/116; F21W 2131/10

USPC ..... 362/362, 368

See application file for complete search history.

(56) References Cited

U.S. PATENT DOCUMENTS

| | | | |
|---|---|---|---|
| 4,434,456 | A | 2/1984 | Taylor |
| 7,134,873 | B2 | 11/2006 | Miyaji et al. |
| 7,452,204 | B2 | 11/2008 | Tsunori |

(Continued)

OTHER PUBLICATIONS

Non-Final Office Action for U.S. Appl. No. 15/477,435, dated Dec. 27, 2018, 7 pages.

(Continued)

*Primary Examiner* — Karabi Guharay

(74) *Attorney, Agent, or Firm* — Withrow & Terranova, P.L.L.C.

(57) ABSTRACT

Tenon-mounted lighting fixtures with high structural integrity are provided. In one embodiment, the lighting fixture has a housing that has an integrally formed tenon cradle, which is configured to receive a tenon of a light pole. A light source is also mounted on a bottom side of the housing. The tenon cradle is between a first bolt boss and a second bolt boss, and is in communication with a rear opening of the housing. The first and second bolt bosses may be integrally formed in the housing. The tenon cradle includes multiple ribs. An arcuate cross rib resides in a first plane in which a first bolt shaft of the first bolt boss and a second bolt shaft of the second bolt shaft reside. An axial rib intersects the arcuate cross rib and runs perpendicular to the first plane.

20 Claims, 26 Drawing Sheets

(56) References Cited

U.S. PATENT DOCUMENTS

| | | | | |
|---|---|---|---|---|
| 8,251,696 | B2 | 8/2012 | Rodriguez et al. | |
| 10,473,308 | B2 * | 11/2019 | Fisher | F21S 8/086 |
| 2012/0218769 | A1 * | 8/2012 | Van Horn | F21V 17/002 362/370 |
| 2015/0253488 | A1 | 9/2015 | Wilcox et al. | |
| 2018/0283629 | A1 | 10/2018 | Fisher et al. | |

OTHER PUBLICATIONS

Final Office Action for U.S. Appl. No. 15/477,435, dated Jun. 5, 2019, 6 pages.
Notice of Allowance and AFCP 2.0 Decision for U.S. Appl. No. 15/477,435, dated Jul. 25, 2019, 8 pages.

* cited by examiner

LIGHTING FIXTURE WITH HIGH STRUCTURAL INTEGRITY

RELATED APPLICATIONS

This application is a continuation of U.S. patent application Ser. No. 15/477,435, filed on Apr. 3, 2017 now U.S. Pat. No. 10,473,308, the disclosure of which is hereby incorporated herein by reference in its entirety.

FIELD OF THE DISCLOSURE

The present disclosure relates to lighting fixtures, and in particular to outdoor lighting fixtures with high structural integrity.

BACKGROUND

Outdoor lighting fixtures present designers with a variety of challenges. Not only do these lighting fixtures have to withstand extreme environmental conditions, such as excessive winds and extreme humidity and temperature swings, but they also need to be lightweight, easy to install without being damaged, and economical to produce. Decreasing the weight of the lighting fixtures makes installation easier and safer for the installer. A single installer can safely handle a large highway-size fixture, where it traditionally took two people to install each fixture. Decreasing the fixture weight can also allow the lighting fixtures to be mounted onto less-expensive and/or taller poles.

In an effort to reduce weight as well as manufacturing costs, lighting fixtures are transitioning from employing metal housings to housings made from lighter weight composites, such as bulk molding compounds and the like. When employing composite materials, care must be taken to make sure that the lighting fixtures can withstand abuses associated with installation. For the latter, a lighting fixtures is often attached to a tenon of a pole using a metal clamping mechanism, which generally requires the tightening of bolts to attach to lighting fixtures to the tenon. Since the clamping mechanism must be attached to the composite housing of the lighting fixture, over-tightening of these bolts, which is commonplace during installation, may break, fracture, crack, or otherwise damage various portions of the composite housing. Accordingly, there is a continuing need to develop lightweight, composite housings for outdoor lighting fixtures that are able to withstand environmental forces and installation abuses.

SUMMARY

The present disclosure relates to lighting fixtures, and in particular to tenon-mounted lighting fixtures that have high structural integrity. In one embodiment, the lighting fixture has a housing that has an integrally formed tenon cradle, which is configured to receive a tenon of a light pole. A light source is also mounted on a bottom side of the housing. The tenon cradle is between a first bolt boss and a second bolt boss, and is in communication with a rear opening of the housing. The first and second bolt bosses may be integrally formed in the housing. The tenon cradle includes multiple ribs. An arcuate cross rib resides in a first plane in which a first bolt shaft of the first bolt boss and a second bolt shaft of the second bolt shaft reside. An axial rib intersects the arcuate cross rib and runs perpendicular to the first plane. The axial rib may be straight or curved.

The tenon cradle may further include multiple side ribs. A first side rib may extend between the first bolt boss and a central portion of the rear opening. A second side rib may extend between the second bolt boss and the central portion of the rear opening. Further, angled ribs may extend between the axial rib and at least one of the first side rib and the second side rib.

In certain embodiments, the tenon cradle includes a stepped structure providing multiple tenon platforms configured to receive an end of the tenon of the light pole at one of multiple different levels to select from a range of different angles of the fixture relative to the tenon, the axial rib residing between the rear opening and the stepped structure. The tenon cradle may also include a higher angle surface and a lower angle surface near the rear opening. The higher angle surface is arcuate and in communication with the rear opening. The lower angle surface is adjacent the higher angle surface and between the rear opening and the higher angle surface. The higher angle surface provides a first surface for the tenon to rest at the rear opening when the end of the tenon is received at a higher level of the stepped structure, and the lower angle surface provides a second surface for the tenon to rest at the rear opening when the end of the tenon is received at a lower level of the stepped structure. An axial channel may be formed in the axial rib at the rear opening of the housing to aid alignment of the tenon and provide two points of loading for the tenon at the rear opening of the housing. If the upper and lower angle surfaces are present, the axial channel may extend across both the higher angle surface and the lower angle surface.

A top portion of the housing may include first and second housing recesses. The first housing recess provides a first elongated landing area over the first bolt boss and exposes the first bolt shaft. The second housing recess provides a second elongated landing area over the second bolt boss and exposes the second bolt shaft. A clamp assembly is used to attach the tenon to the housing. The clamp assembly may include cradle bracket, a first bolt, a second bolt, a first elongated nut, and a second elongated nut.

In one embodiment, the cradle bracket comprises a first wing with a first hole, a second wing with a second hole, and a tenon interface between the first wing and the second wing. The tenon interface is configured to engage the tenon when the tenon is within the tenon cradle, and may include a gripping surface. The first elongated nut resides in the first housing recess on the first elongated landing area. The second elongated nut resides in the second housing recess on the second elongated landing area. The first bolt extends through the first hole of the cradle bracket and the first bolt shaft of the first bolt boss and threads into the first elongated nut. The second bolt extends through the second hole of the cradle bracket and the second bolt shaft of the first bolt boss and threads into the second elongated nut. Sidewalls of the first housing recess and the second housing recess prevent the first elongated nut and the second elongated nut from spinning about the first bolt and the second bolt within the first housing recess and second housing recess, respectively.

In select embodiments, the cradle bracket includes opposing sidewalls such that the first wing and the second wing reside between the opposing sidewalls. The tenon interface is provided by arcuate recesses in the bottom of the opposing sidewalls. The cradle bracket may have an interior opening between the first wing and the second wing, as well as first and second interior walls. The first interior wall is coupled to the first wing and located between and perpendicular to the opposing sidewalls, and the second interior wall is coupled to the second wing and located between and perpendicular to the opposing sidewalls. As such, the interior opening resides between the first interior wall and the second interior wall. Gaps may separate the opposing sidewalls from each of the first interior wall and the second interior wall. Top portions of the opposing sidewalls may curve inward toward the first interior wall and the second interior wall, but not touch the first interior wall and the second interior wall. Preferential bending regions are provided on each of the opposing sidewalls proximate boundaries of the interior opening and the first wing and the interior opening of the second wing. The preferential bending regions facilitate bending about points between a central portion of the cradle bracket and the first wing as well as between the central portion of the cradle bracket and the second wing. The first hole of the first wing and the second hole of the second wing may be tapped to provide threads that strip under excessive forces.

In certain embodiments, the first and second elongated nuts are weld nuts. An outer periphery of the first elongated nut may be substantially coincident with an outer periphery of the first elongated landing area. An outer periphery of the second elongated nut may be substantially coincident with an outer periphery of the second elongated landing area.

In yet further embodiments, no dimension of the arcuate cross rib and the axial rib is less than 11 millimeters, especially when the housing is formed from a polymer or like bulk molding compound.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 1:
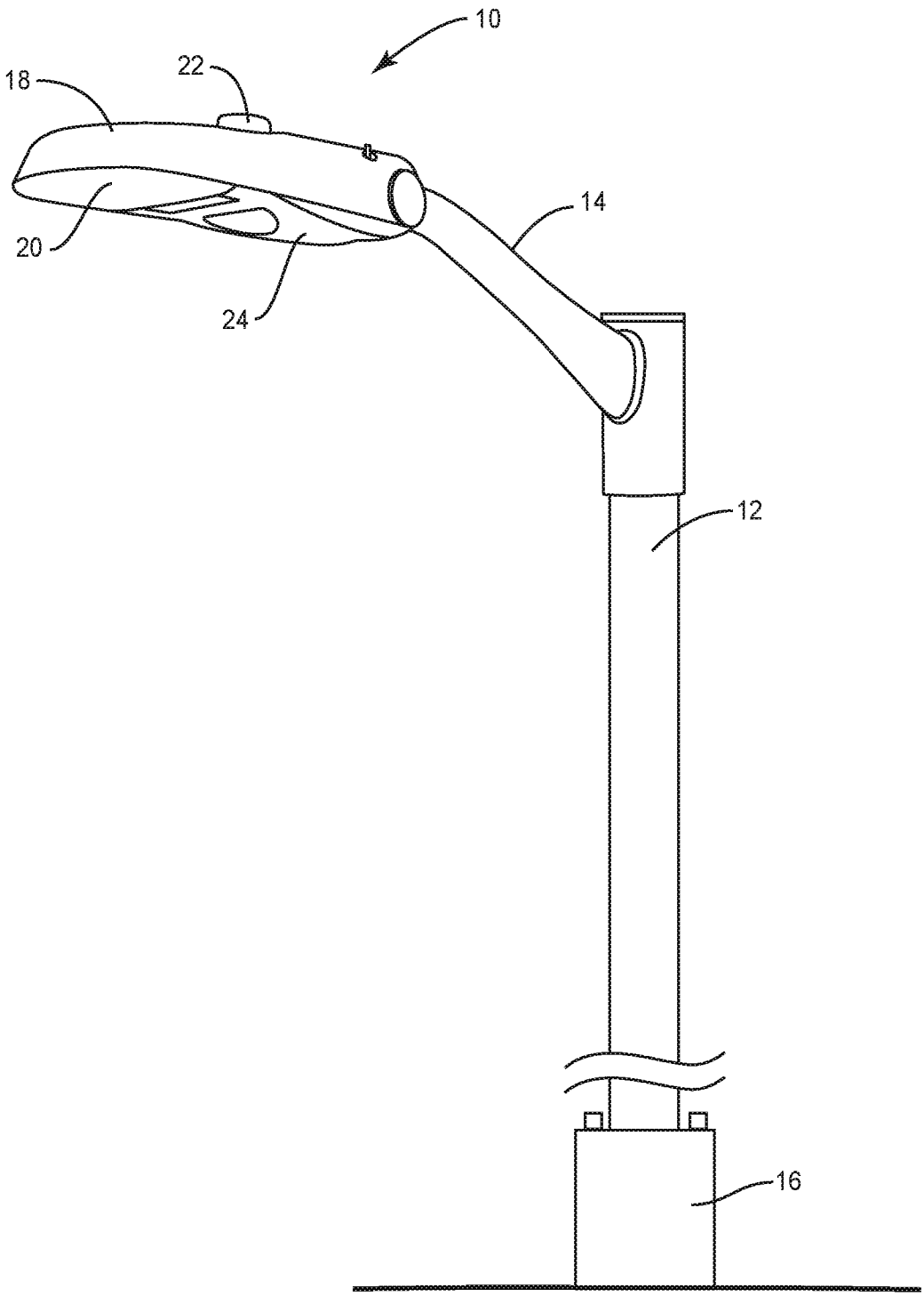
FIG. 1 illustrates an outdoor lighting fixture mounted to a utility pole according to one embodiment of the disclosure.

With reference to FIG. 1, a lighting fixture 10 is mounted to a utility pole 12 by a tenon 14. The tenon 14 in this example extends outward from a top portion of the utility pole 12, and the lighting fixture 10 is attached to the free end of the tenon 14. The bottom of the utility pole 12 may be mounted to a pole base 16, which is securely mounted in or on the ground or other surface. As provided herein, the tenon 14 is defined as the mounting structure to which the lighting fixture 10 is directly mounted. The tenon 14 may be an integral extension or part of the utility pole 12, attached to the utility pole 12, or attached directly to a structure other than a pole, such as a building, wall, frame, sign, and the like.

Typically, the lighting fixture 10 has a housing 18 in which a light source 20 and an ambient light sensor 22 are mounted. In normal operation, the ambient light sensor 22 provides information bearing on ambient light levels, and based on these ambient light levels, the light source 20 will turn on and off. When ambient light levels fall below a certain level, the light source 20 will turn on, and when ambient light levels rise above a certain level, the light source 20 will turn off in traditional fashion. While the light source 20 may take various configurations, the one illustrated incorporates light emitting diodes (LEDs) and sufficient control circuitry to drive the LEDs as desired in response to information provided by the ambient light sensor 22 as well as any other sensors, such as occupancy, motion, sound, vibration, temperature, and like sensors, as well as a wired or wireless controllers. As described further below, an access cover 24 provides access to the interior of the housing 18. Such access may facilitate connecting the light source power as well as securely attaching the lighting fixture 10 to the tenon 14.

The housing 18 and the access cover 24 may be formed using an over-molding process that employs various mold compounds, such as thermoset bulk molding compounds, fiber reinforced thermoplastics, or un-filled thermoplastics. These mold compounds may be polymer based, but are not limited thereto, and may include various types of fibers, such as glass fibers, for reinforcement. With an over-mold process, the housing 18 and the various features thereof may be integrally formed as a single structure. Further, various features that are provided on or within the housing 18 may be affixed to, surrounded by, or otherwise formed within the structure. The tenon 14 may be formed from the same or different materials as the housing 18. In various embodiments, the tenon 14 may be formed from metals, such as, aluminum and steel, as well as from composite materials, such as carbon reinforced polymers and the like.

Figure 2:
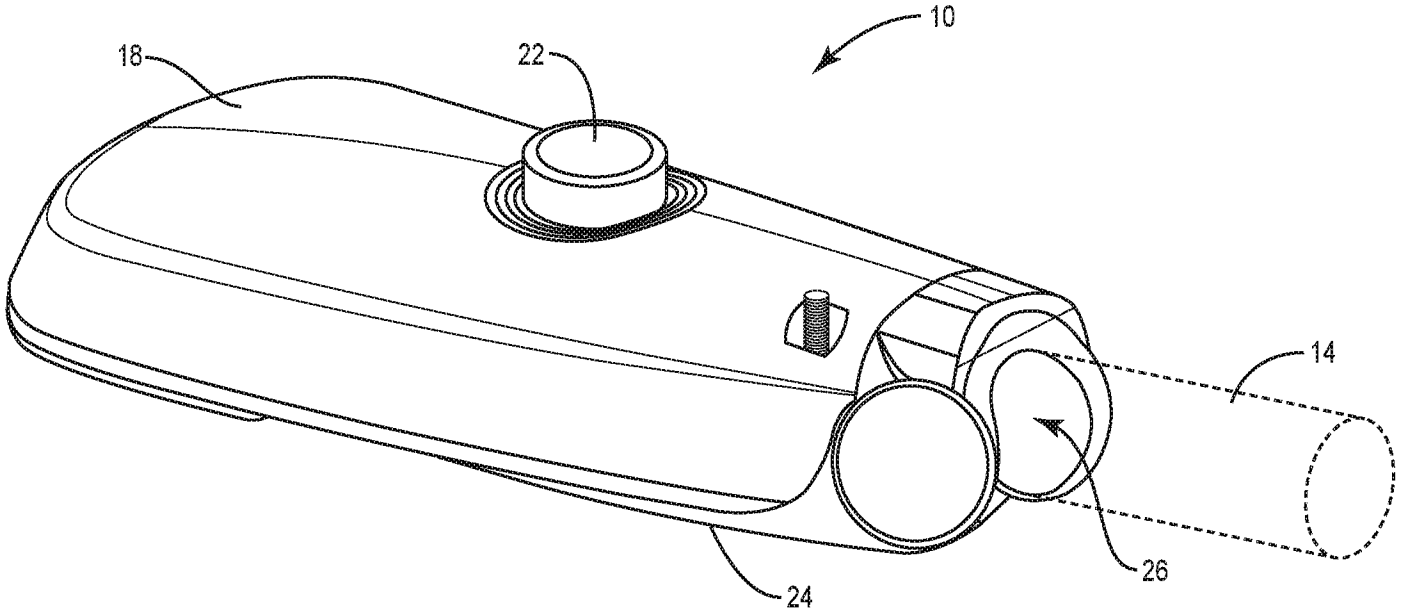
FIG. 2 illustrates a top-rear isometric view of the lighting fixture of FIG. 1.
Figure 3:
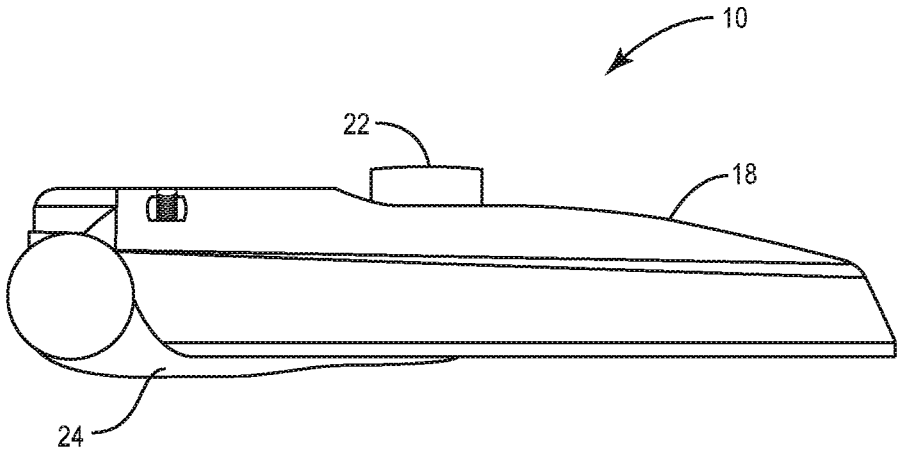
FIG. 3 is a side plan view of the lighting fixture of FIG. 1.
Figure 4:
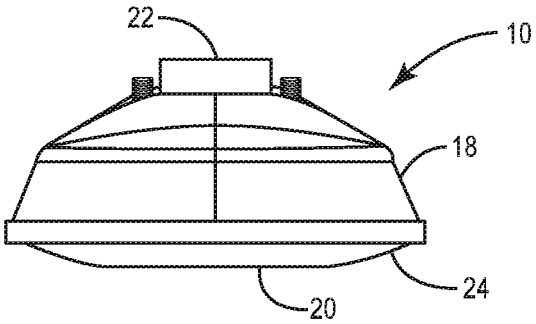
FIG. 4 is a front plan view of the lighting fixture of FIG. 1.
Figure 5:
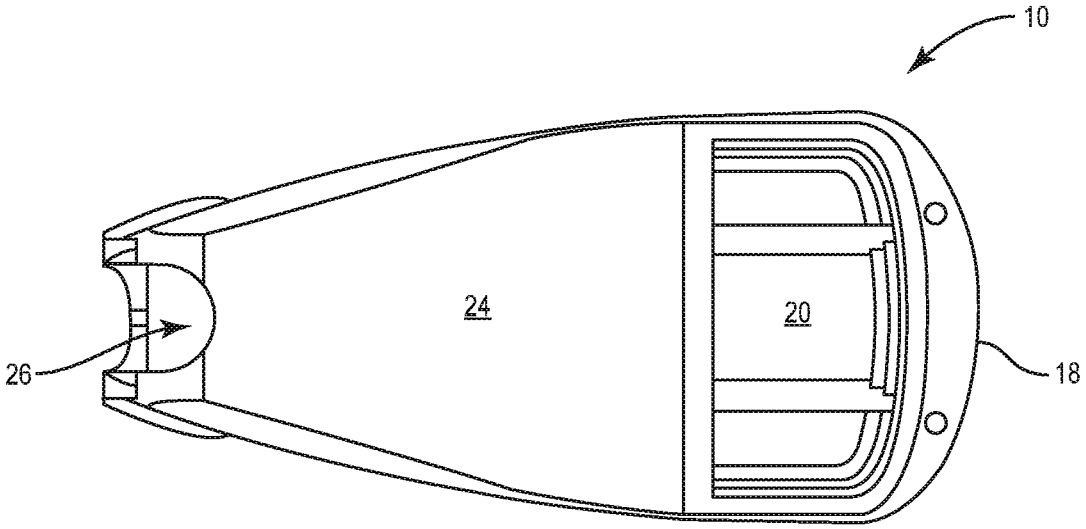
FIG. 5 is a bottom plan view of the lighting fixture of FIG. 1.
Figure 6:
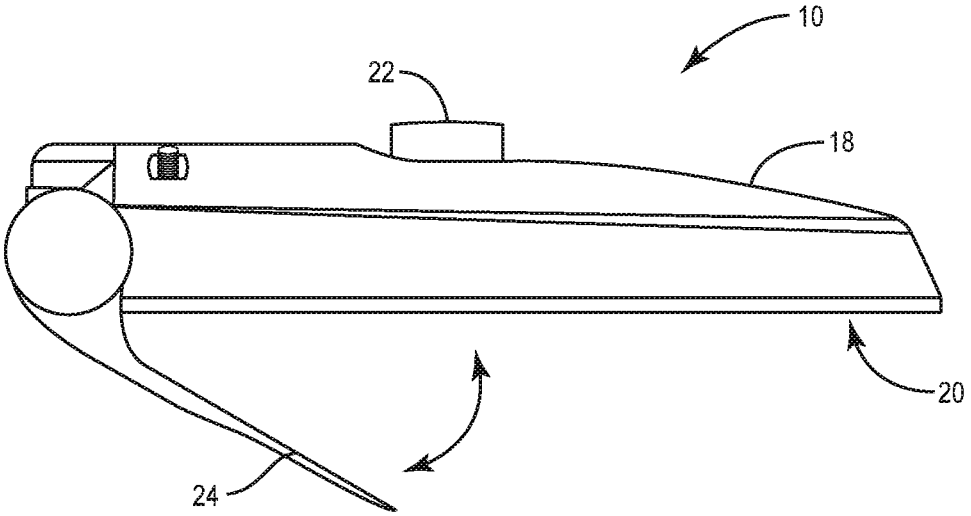
FIG. 6 is a side plan view of the lighting fixture of FIG. 1, wherein the access cover is in an open position.

FIG. 2 provides a rear isometric view of the lighting fixture 10. An opening at the rear of the lighting fixture 10 is referred to as the tenon cradle 26. The tenon cradle 26 receives the tenon 14, and an attachment mechanism, which will be described further below, is used to securely attach the lighting fixture 10 to the tenon 14. FIGS. 3, 4, and 5, provide side, front, and bottom views, respectively, of the lighting fixture 10. FIG. 6 provides a side view of the lighting fixture 10 wherein the access cover 24 is opened to provide access to the interior of the housing 18. In this embodiment, the access cover 24 is hinged at the rear of the housing 18 and rotates downward to provide access to the interior of the housing 18. The access cover 24 may use various mechanisms to lock into a closed position. These mechanisms may range from fasteners, such as screws and bolts, to snap-fit and magnetic configurations.

Figure 7:
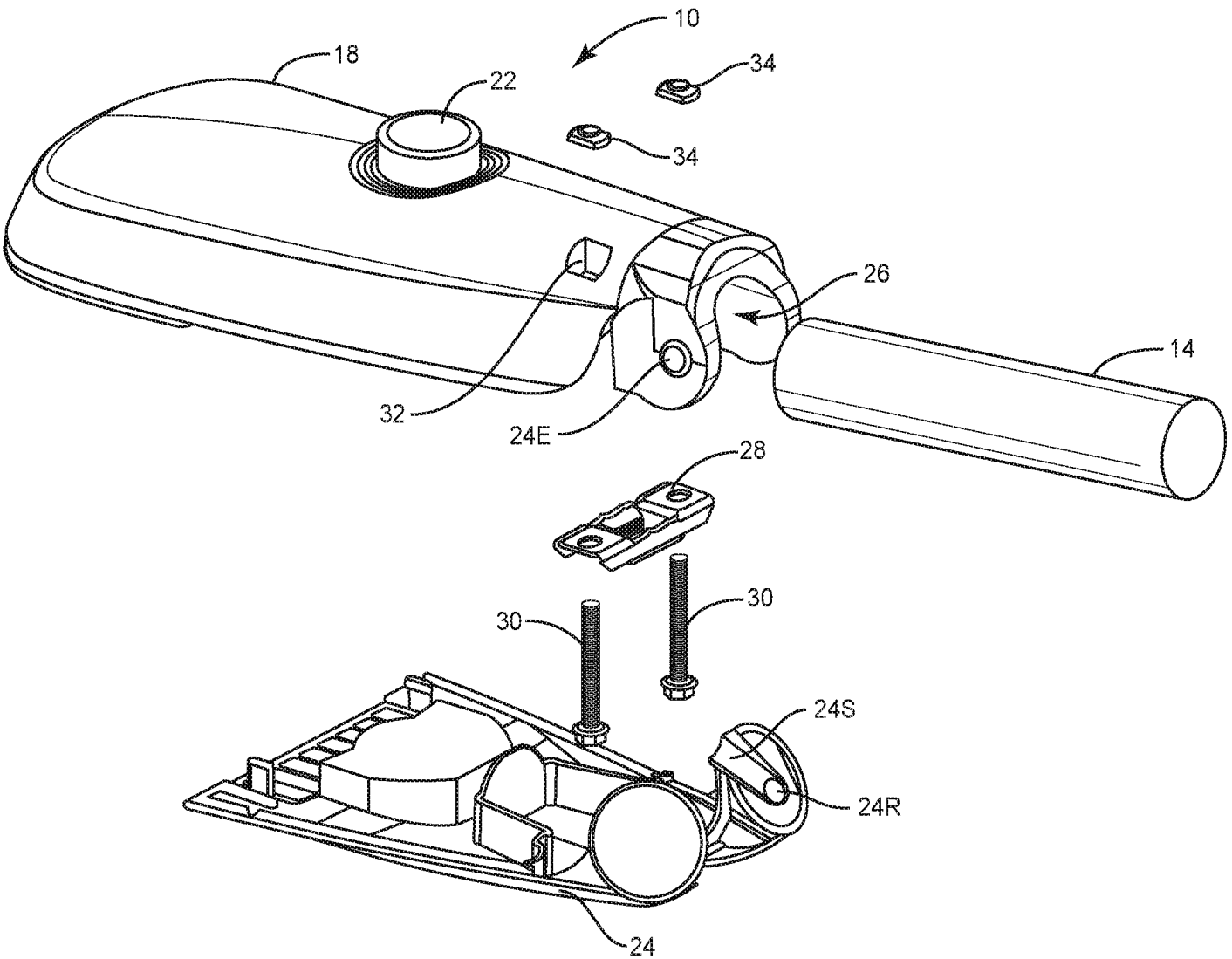
FIG. 7 is an exploded, top-rear isometric view of the lighting fixture of FIG. 1.

FIG. 7 is an exploded, top-rear isometric view of the lighting fixture 10. As illustrated, a cradle bracket 28 and two bolts 30 are used to clamp the tenon 14 in the tenon cradle 26 at the rear of the lighting fixture 10. The bolts 30 extend through the cradle bracket 28 and through the housing 18. In particular, the bolts 30 extend into housing recesses 32 that are recessed into the top surface of the housing 18. The bolts 30 thread into nuts, such as weld nuts 34, which generally correspond to the shape and size of the housing recesses 32. In this embodiment, the housing recesses 32 and the weld nuts 34 are substantially elongated and rectangular, such that the housing recesses 32 both receive the weld nuts 34 and prevent the weld nuts 34 from rotating as the bolts 30 are threaded into the weld nuts 34 and tightened to clamp the tenon 14 in the tenon cradle 26. The cradle bracket 28 is described in further detail below.

Figure 8:
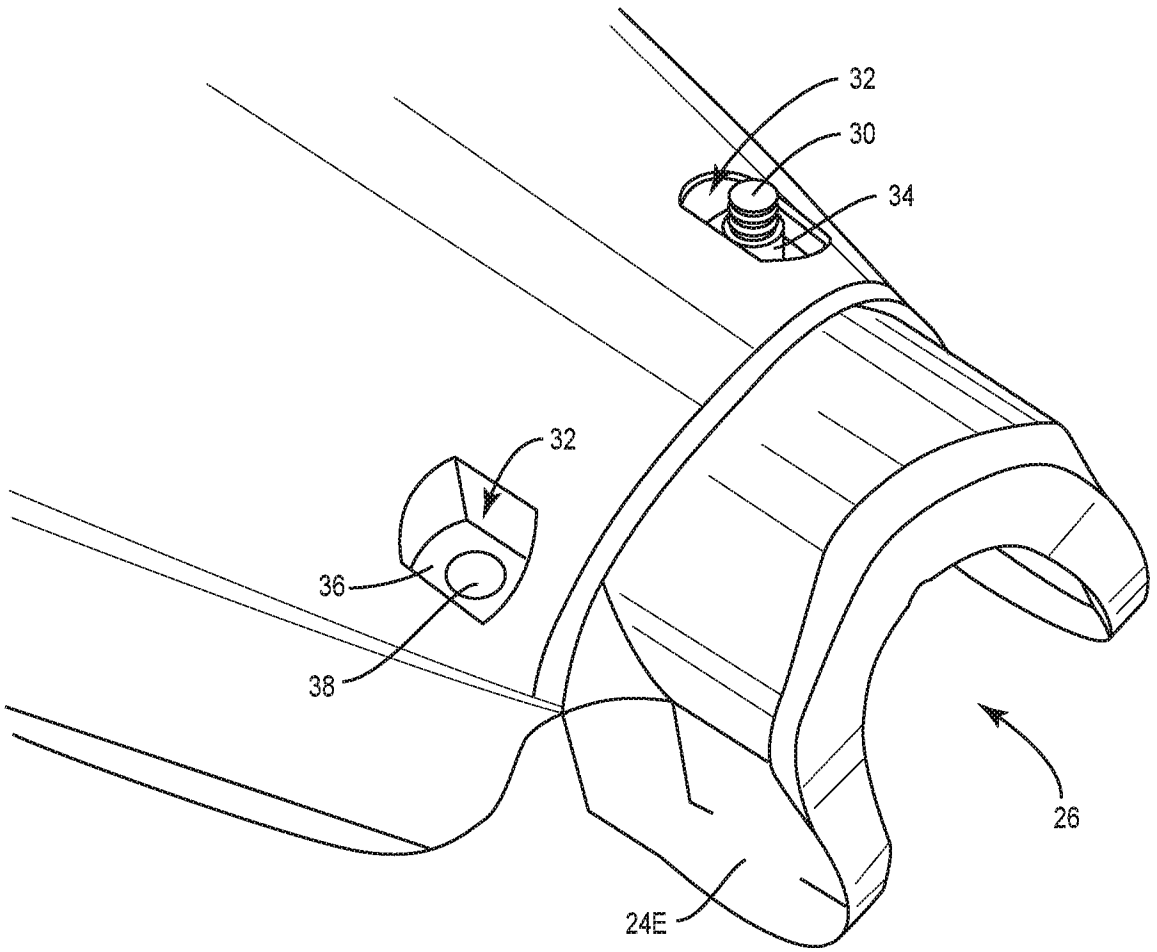
FIG. 8 is a top-rear isometric view of a housing for the lighting fixture of FIG. 1.

FIG. 8 is an enlarged, rear isometric view of the lighting fixture 10. The lower housing recess 32 is shown without the bolt 30 and weld nut 34, such that the landing area 36 for the weld nut 34 and a bolt shaft 38 for the bolt 30 are visible. The upper housing recess 32 is shown with the weld nut 34 and the bolt 30 in place. In the illustrated embodiment, the weld nut 34, the bolt 30, and a portion of the housing recess 32 remain exposed when the lighting fixture 10 is mounted to the tenon 14.

In essence, the weld nuts 34 include an elongated flange with an internally threaded hole designed to receive the bolt 30. As indicated above, the elongated flange of the weld nuts 34 generally coincide with the shape and size of the landing area 36 of the housing recesses 32. The longer dimension of each housing recess 32 may be substantially parallel with the longer dimension of the tenon cradle 26, and thus parallel with the tenon 14, in an effort to reduce the overall width of the rear of the housing 18 while maintaining sufficient space for the tenon cradle 26. In one embodiment, the landing areas 36 and the weld nuts 34 are sized such that the sidewalls of the housing recesses 32 prevent the weld nuts 34 from turning as the bolts 30 are tightened; as such, a wrench or socket is not necessary for the weld nuts 34. Only the bolts 30 require tools for installation. While weld nuts 34 are depicted, virtually any type of nut may be employed.

Figure 9:
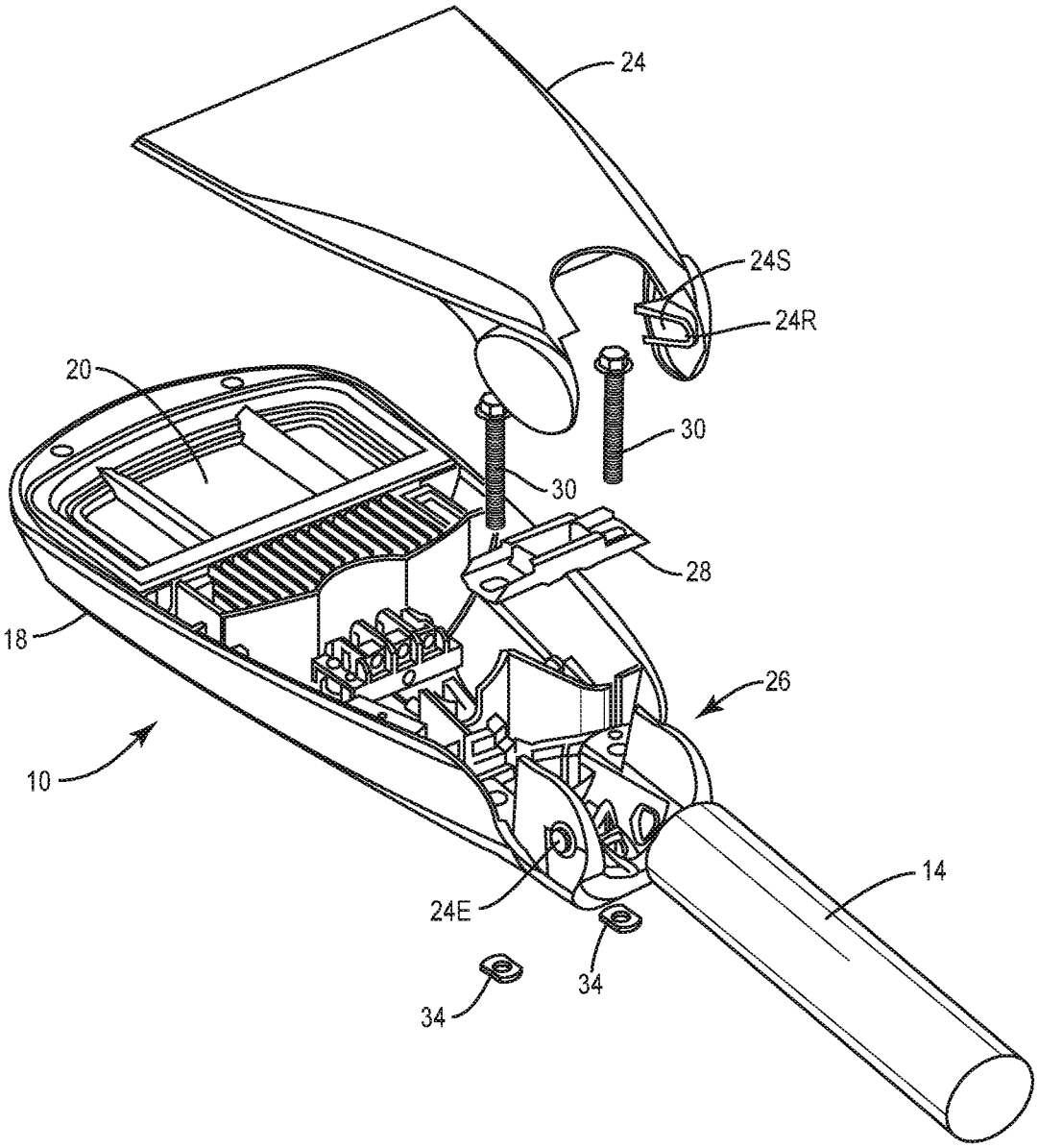
FIG. 9 is an exploded, bottom-rear isometric view of the lighting fixture of FIG. 1.

With reference to FIG. 7 and FIG. 9, which are exploded, bottom-rear isometric views of the lighting fixture 10, an exemplary mechanism is illustrated for attaching the access cover 24 to the housing 18. As illustrated, the rear of the housing 18 includes a mounting extension 24E. The rear of the access cover 24 includes two disc-shaped mounting ears that substantially oppose one another. On the inside of each of these mounting ears is a slot 24S that leads to a mounting recess 24R. The mounting ears slip over the rear of the housing 18 such that the mounting extensions 24E of the housing 18 slide down the slots 24S and snap into the mounting recesses 24R of the access cover 24. Once the access cover 24 is affixed to the housing 18, the access cover 24 will pivot about the mounting recesses 24R on the mounting extensions 24E of the housing 18.

Figure 10:
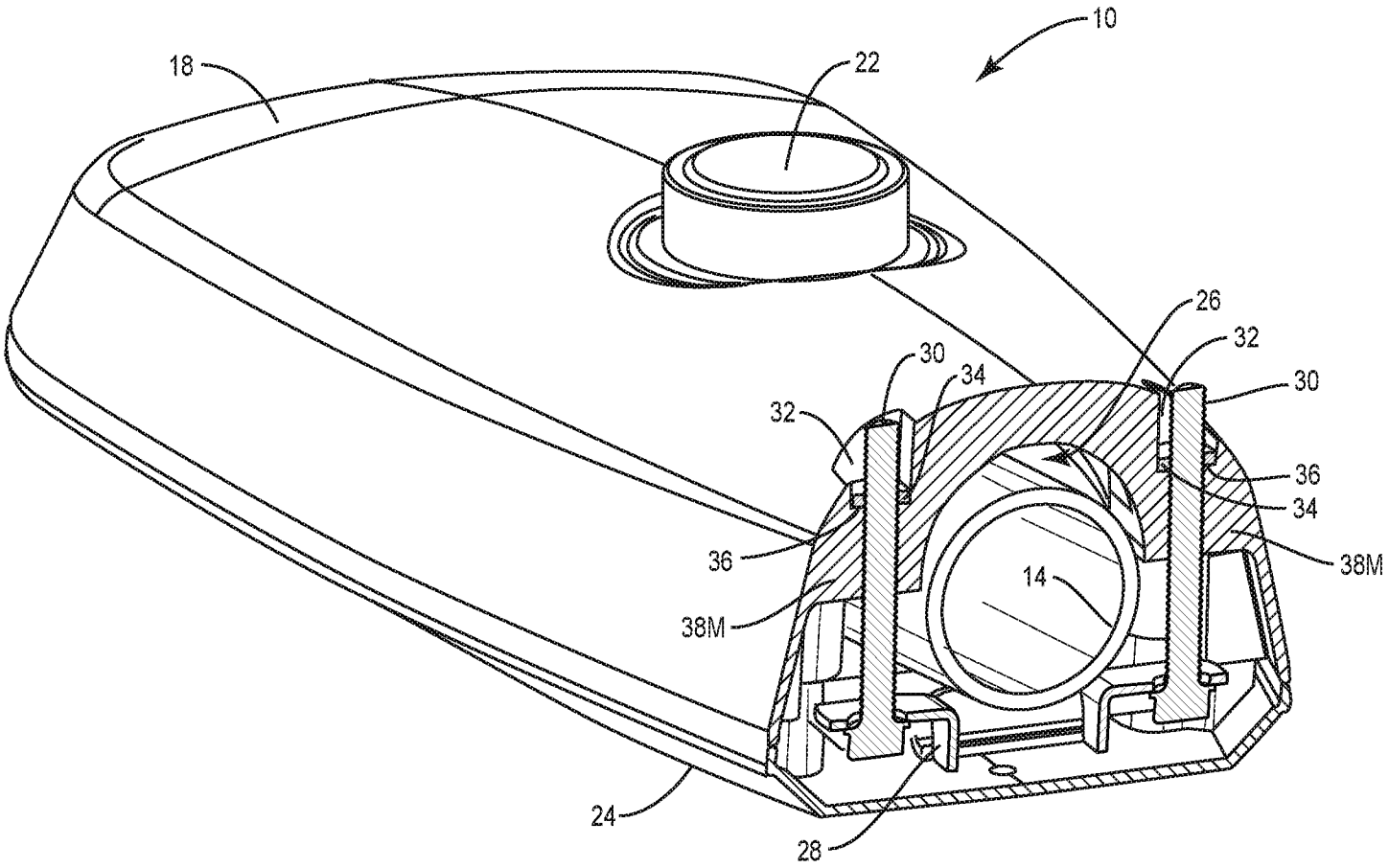
FIG. 10 is a cross-sectional, top-rear isometric view of the lighting fixture of FIG. 1.

FIG. 10 is a cross-section of the lighting fixture 10 taken through the bolts 30 and cradle bracket 28. As illustrated, the housing 18 of the lighting fixture 10 is clamped to the tenon 14 by sandwiching the tenon 14 between the cradle bracket 28 and interior portions of the tenon cradle 26 of the housing 18. Again, the weld nuts 34 rest inside the housing recesses 32, and the bolts 30 are threaded into the weld nuts 34 to press the cradle bracket 28 against the tenon 14 and the tenon 14 itself against the interior portions of the tenon cradle 26. The weld nuts 34 may have a designed stripping feature wherein the threads of the weld nuts 34 strip with a torque in excess of 350 in-lbs-450 in-lbs is provided.

As illustrated, the bolts 30 extend through bolt bosses 38M, which are integrally formed in the housing 18 and reside just below the landing areas 36 of the housing recesses 32. As such, the bolt bosses 38M may each have a shaft through which a bolt 30 extends. This shaft may have a diameter that increases as the landing area 36 is approached. In other words, the diameter of the shaft will increase through the shaft from the head of the bolt 30 to the weld nut 34. Configuring the shaft in this manner provides more room for the bolts 30 to move at the landing areas 36, which helps prevent fracturing or cracking of the housing 18, as well as making the shafts easier to form during the molding process (draft angle for molding). The height of the bolt bosses 38M, as measured by the length of the shaft therethrough, also plays a role in enhancing structural integrity of the housing 18. Generally, increasing the height of the bolt bosses 38M increases the structural integrity of the housing 18, especially in those areas surrounding the bolt bosses 38M and the tenon cradle 26. This increased length provides a higher aspect ratio of contact over length which prevents the bolt from tipping at an angle and side-loading the bolt bosses. In various embodiments, the height of the bolt bosses 38M are at least 20 mm, 22.5 mm, 24 mm, 25 mm, and 30 mm.

Figure 11:
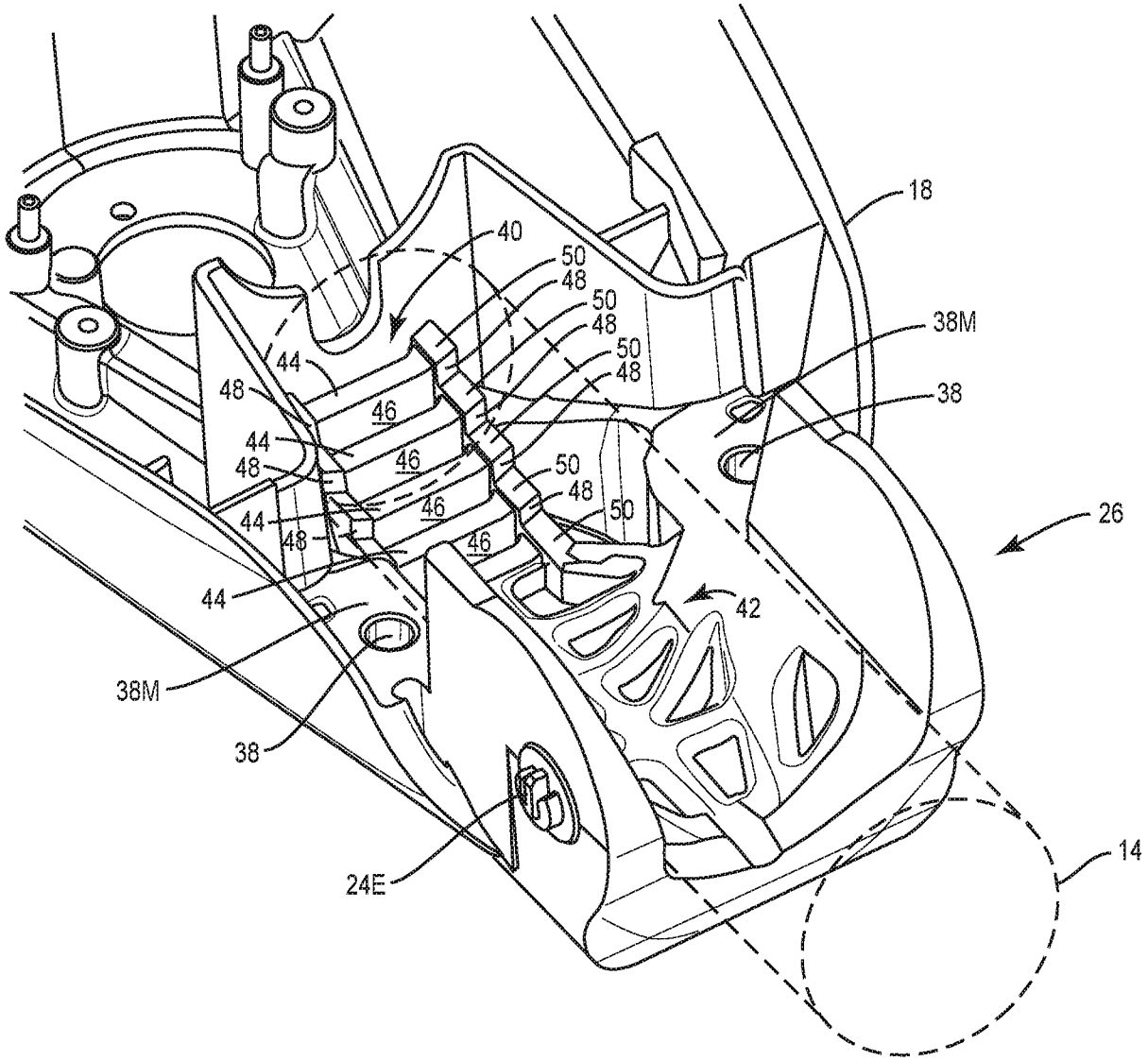
FIG. 11 is a bottom-rear isometric view of the housing of the lighting fixture of FIG. 1.
Figure 12:
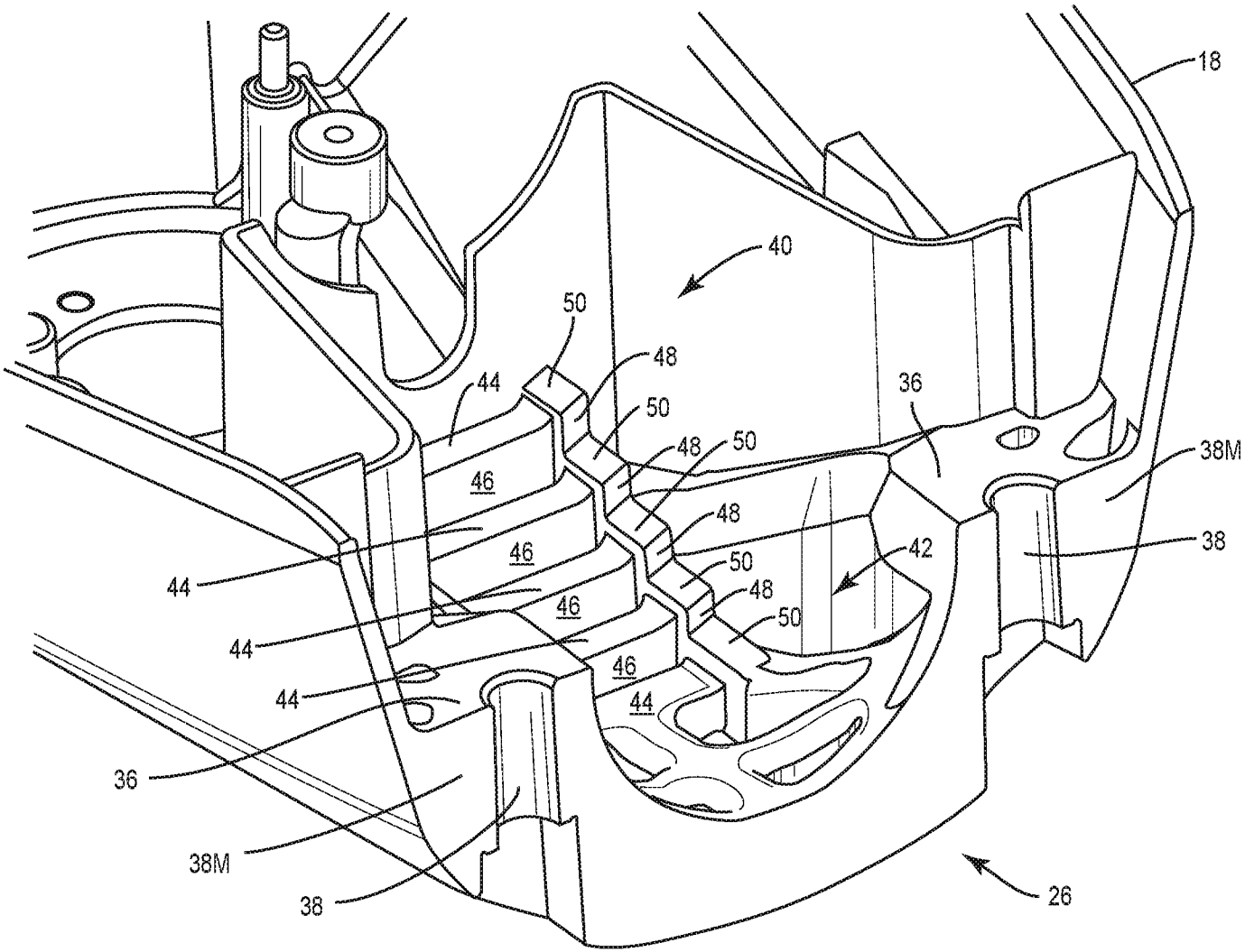
FIG. 12 is a cross-sectional, bottom-rear isometric view of the housing of the lighting fixture of FIG. 1.

FIGS. 11 and 12 provide enlarged isometric views of the tenon cradle 26 of the housing 18. The tenon cradle 26 includes two general structures: a stepped structure 40 and a rib structure 42, which resides between the stepped structure 40 and the rear of the housing 18. The stepped structure 40 provides a leveling mechanism for the lighting fixture 10 and includes multiple downward-facing steps 44 that transition from a first level to a base level. Each step 44 is separated by a riser 46. Note that the term "downward" relates to the installed orientation of the lighting fixture 10. As illustrated, the downward-facing steps 44 actually face upward, because the lighting fixture 10 is shown in an inverted orientation. Each step 44 is bracketed by opposing outer pole platforms 48, which have platform surfaces 50. Each pair of platform surfaces 50 for a given step 44 are beveled inward to form a V-shape such that a round or oval tenon 14 of sufficient diameter will rest securely between a pair of platform surfaces 50. During installation, the tenon 14 is placed on the step 44 that corresponds to the lighting fixture 10 being most level. As such, portions of the outside surface of the tenon 14 will rest on the platform surfaces 50 of the outer pole platforms 48 of the selected step 44. The end of the tenon 14 may rest against the associated riser 46. In one embodiment, larger diameter tenons 14, such as those with a standard outside diameter of 2.38 inches, will only rest on the platform surfaces 50 for a given step 44. Smaller diameter tenons 14, such as those with a standard outside diameter of 1.66 inches, may rest directly on the selected step 44 and between inside portions of the respective outer pole platforms 48. These portions may correspond to the junction between the inside walls and the platform surfaces 50 of the outer pole platforms 48.

Figure 13:
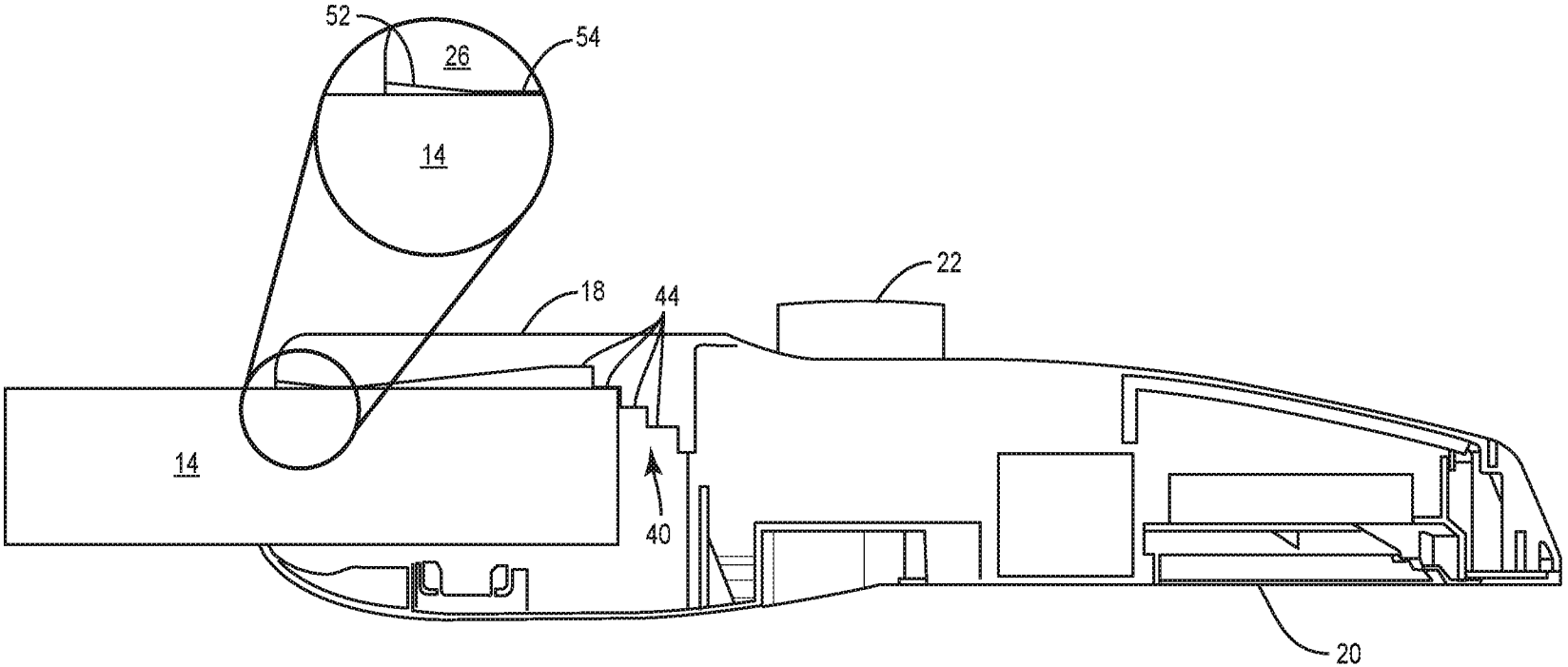
FIG. 13 is a side cross-sectional view of the lighting fixture of FIG. 1, wherein the tenon is positioned on an upper step.
Figure 14:
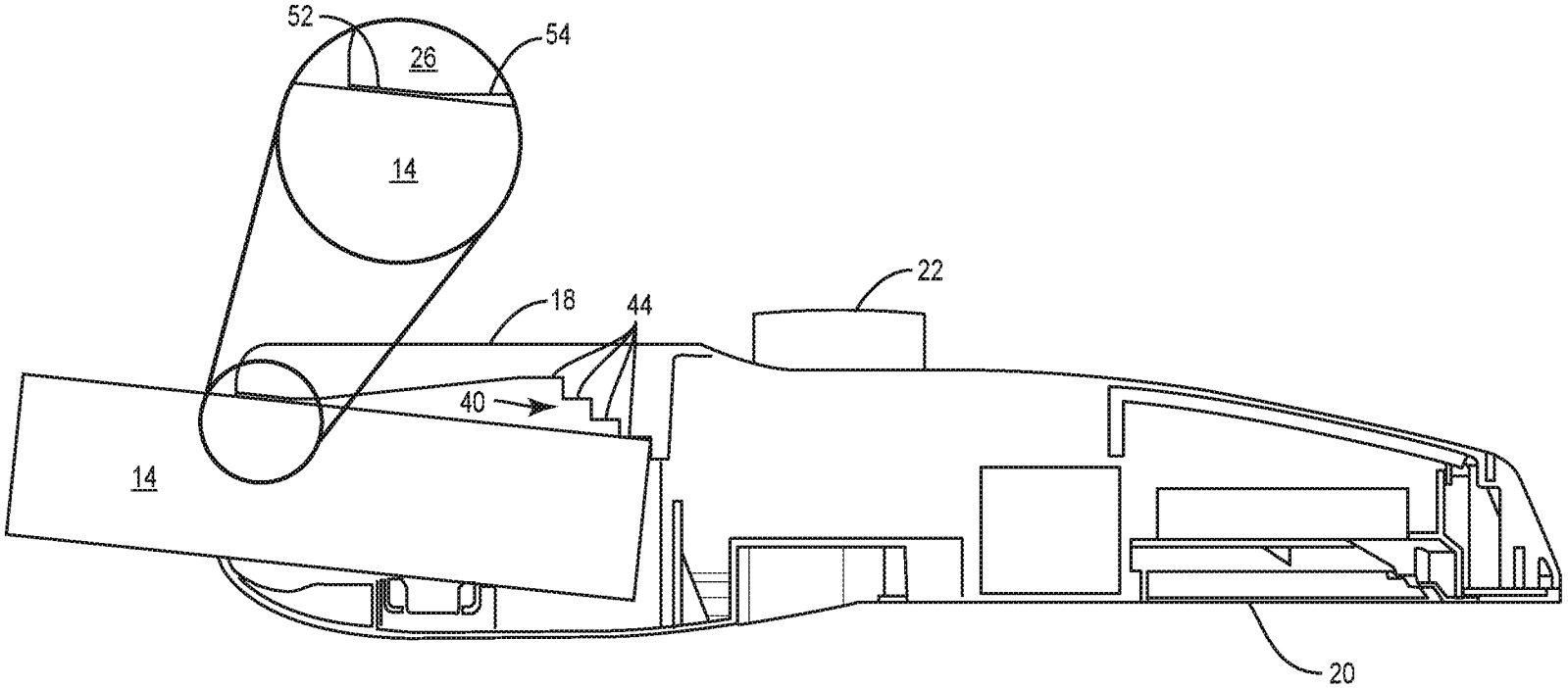
FIG. 14 is a side cross-sectional view of the lighting fixture of FIG. 1, wherein the tenon is positioned on a lower step.

FIGS. 13 and 14 illustrate the tenon 14 resting on different steps 44 of the stepped structure 40, wherein the tenon 14 rests on an upper step in FIG. 13 and the lower step in FIG. 14. Further, the entrance to the tenon cradle 26 may include multiple pole resting surfaces, wherein the different surfaces reside on different angles. The balloons in FIGS. 13 and 14 illustrate two of the surfaces, which are referred to as a lower angle surface 52 and a higher angle surface 54. In FIG. 13, where the tenon 14 rests on a higher step 44, a portion of the tenon 14 rests on the higher angle surface 54 as well as the platform surfaces 50 for the selected step 44. In FIG. 14, where the tenon 14 rests on a lower step 44, a portion of the tenon 14 rests on the lower angle surface 52 as well as the platform surfaces 50 of the selected step 44. Providing the different lower and higher angle surfaces 52, 54 changes the contact from a line to a surface contact and decreases the stress where the tenon 14 contacts the rear portion of the tenon cradle 26. In certain embodiments, the steps 44 are spaced apart sufficiently to provide +/−2°, +/−2.5°, or +/−3° increments of the housing 18 relative to the tenon 14. In one embodiment there are five steps, wherein the middle step is essentially the horizontal mounting position.

Figure 15:
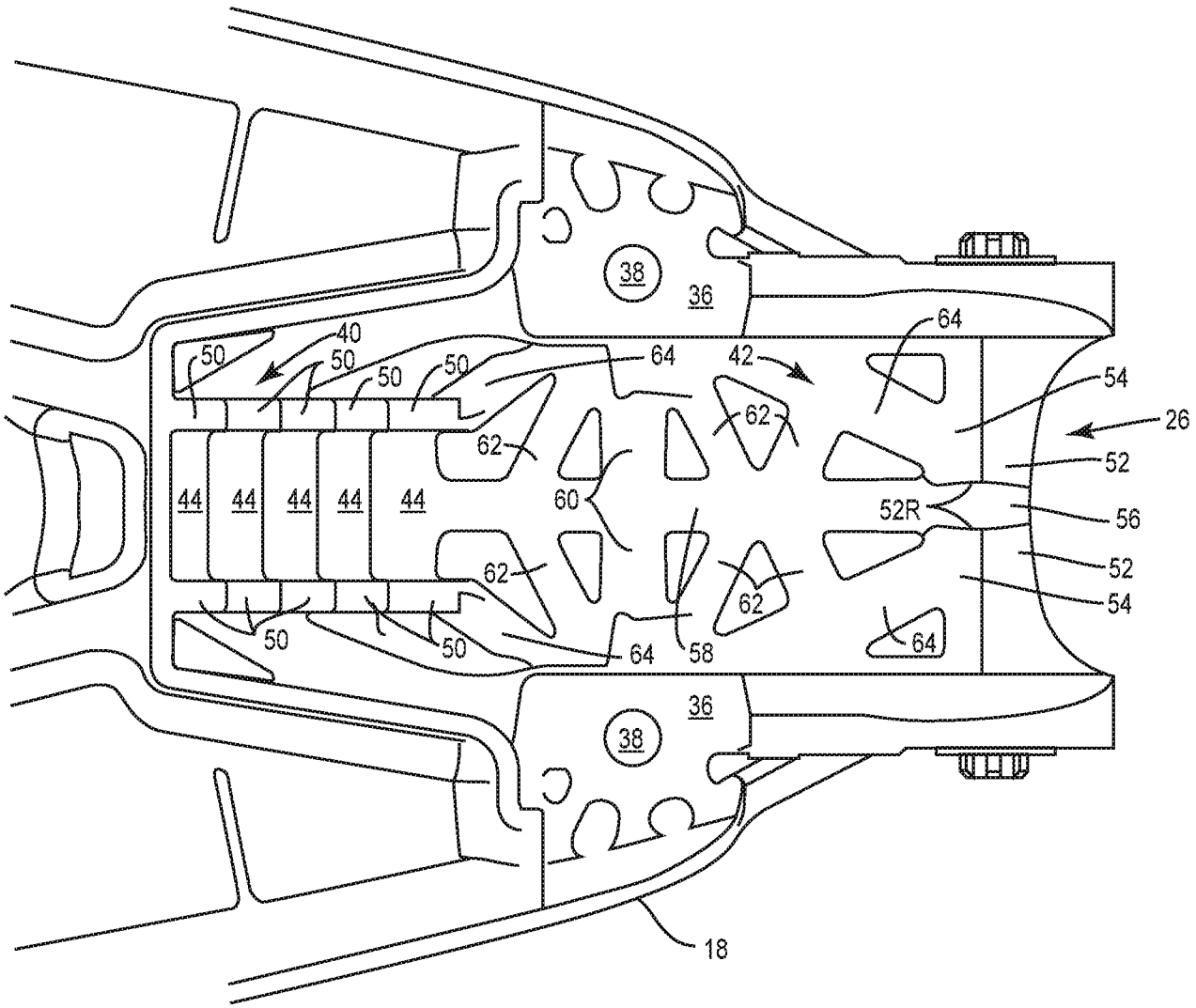
FIG. 15 is a top plan view of the housing of FIG. 1, wherein the tenon cradle is highlighted.

Turning now to FIG. 15, a bottom, plan view of the tenon cradle 26 is illustrated. The rib structure 42 is clearly visible and extends between the base of the stepped structure 40 and the rear opening of the housing 18 (far right). An axial channel 56, or divot, is formed in and extends through a central portion of both the lower angle surface 52 and the higher angle surface 54. The axial channel 56 is configured such that the rounded tenon 14 will naturally align itself on the axial channel 56, and substantially parallel portions of the tenon 14 will rest on channel ridges 52R. The channel ridges 52R are essentially the edges provided at the intersection between the axial channel 56 and the respective higher and lower angle surfaces 52, 54. Employing the axial channel 56 effectively cuts the point load forces on the higher or lower angle surfaces 52, 54 in half, because the point load force along a single line in an embodiment without the axial channel 56 is effectively divided along the two lines presented by the channel ridges 52R. As such, the axial channel 56 divides the point load force presented by the tenon 14 along two channel ridges 52R in addition to providing a mechanism that naturally centers the tenon 14 in the tenon cradle 26 as the cradle bracket 28 is tightened against the tenon 14 during installation. Exemplary radii for axial channel 56 include approximately 3 mm, 3.5 mm, 4 mm, and 4.5 mm.

As indicated above, the tenon 14 will rest on one of the steps 44 or on a pair of the platform surfaces 50 associated with one of the steps 44 and one of the higher or lower angle surfaces 52, 54. The tenon 14 spans the rib structure 42, but does not generally rest on the rib structure 42, unless the base step 44 is essentially on the same plane as the rib structure 42. As such, the portion of the housing 18 that is associated with the rib structure 42 is subjected to tensile forces along the axis of the rib structure 42 and compressive forces perpendicular to the axis of the rib structure 42 when the tenon 14 is held in place by the cradle bracket 28. The rib structure 42 is designed to handle these forces as well as prevent, or at least minimize, damage to or visible deflection of the housing 18.

In the illustrated embodiment, the rib structure 42 includes multiple types of ribs, which include an axial rib 58, a cross rib 60, multiple angled ribs 62, and multiple side ribs 64, all of which may be arcuate. The axial rib 58 is centrally located within the tenon cradle 26 and extends from the stepped structure 40 toward the rear of the tenon cradle 26. As illustrated, the axial rib 58 may extend to the rear of the housing 18 wherein the axial channel 56 is formed within the axial rib 58. The axial rib 58 may be straight or curved depending on the configuration of the tenon cradle 26. The cross ribs 60 are substantially perpendicular to the axial rib 58, whether curved or straight, and extend from the axial rib 58 toward the bolt shafts 38. As such, the cross ribs 60 and the bolt shafts 38 fall within a common plane. The various angled ribs 62 extend from the various points along the axial rib 58 toward the bolt shafts 38 at acute angles relative to the axial rib 58. The side ribs 64 extend from proximate corners of the stepped structure 40 toward the bolt shafts 38, or from a central part of the rear of the tenon cradle 26 toward the bolt shafts 38. In essence, the rib structure 42 provides a mesh of ribs configured to sustain forces associated with attaching the housing 18 of the lighting fixture 10 to the tenon 14.

Each of the various ribs 58, 60, 62, 64 is effectively separated by recesses that are primarily provided to minimize the amount of mold compound used to form the housing 18. The mold compound is relatively expensive, and if used too extensively, can unduly increase the cost to produce the housing 18. However, the ribs should be tall and wide enough to ensure that the components of the mold compound remain adequately mixed to provide the requisite structural integrity. For example, mold compound is poured into a form and cured to generate a particular object. An exemplary mold compound includes a polymer and glass fibers. The polymer tends to separate from the glass fibers along the surfaces of the form, such that a thin layer of fiber-less polymer forms along the surfaces of the form, and higher concentrations of glass fibers mix with the remaining polymer in the interior of the object being formed. As a result, a thin layer of fiber-less polymer forms a "skin" about the object being formed. Without the glass fibers, the skin is prone to chipping, cracking, and fracturing. As the elements in the object being formed become too small, the entire object may be formed with little or no glass fibers, and as a result, will have very low structural integrity. As such, the various elements of the housing 18, especially those subjected to any substantial forces, should be thick enough to ensure that a substantial portion of the elements include an appropriate mixture of glass fibers and polymer, after taking into consideration that each element will have a relatively vulnerable skin of fiber-less polymer. Further, thicker elements facilitate better flow of the liquid mold compound into the various sections of the mold to ensure that the glass fibers are properly oriented.

In certain embodiments, the various ribs 58, 60, 62, 64 are solid and at least 10 mm, 12 mm, or 14 mm tall and/or thick. Using rounded or beveled edges, or other such smooth transitions, for the various elements of the stepped structure 40 and rib structure 42, including the steps 44, risers 46, outer pole platforms 48, and ribs 58, 60, 62, 64 tends to reduce stress and minimize fracture of the elements when they are presented with various compressive and tensile stresses.

Figure 16:
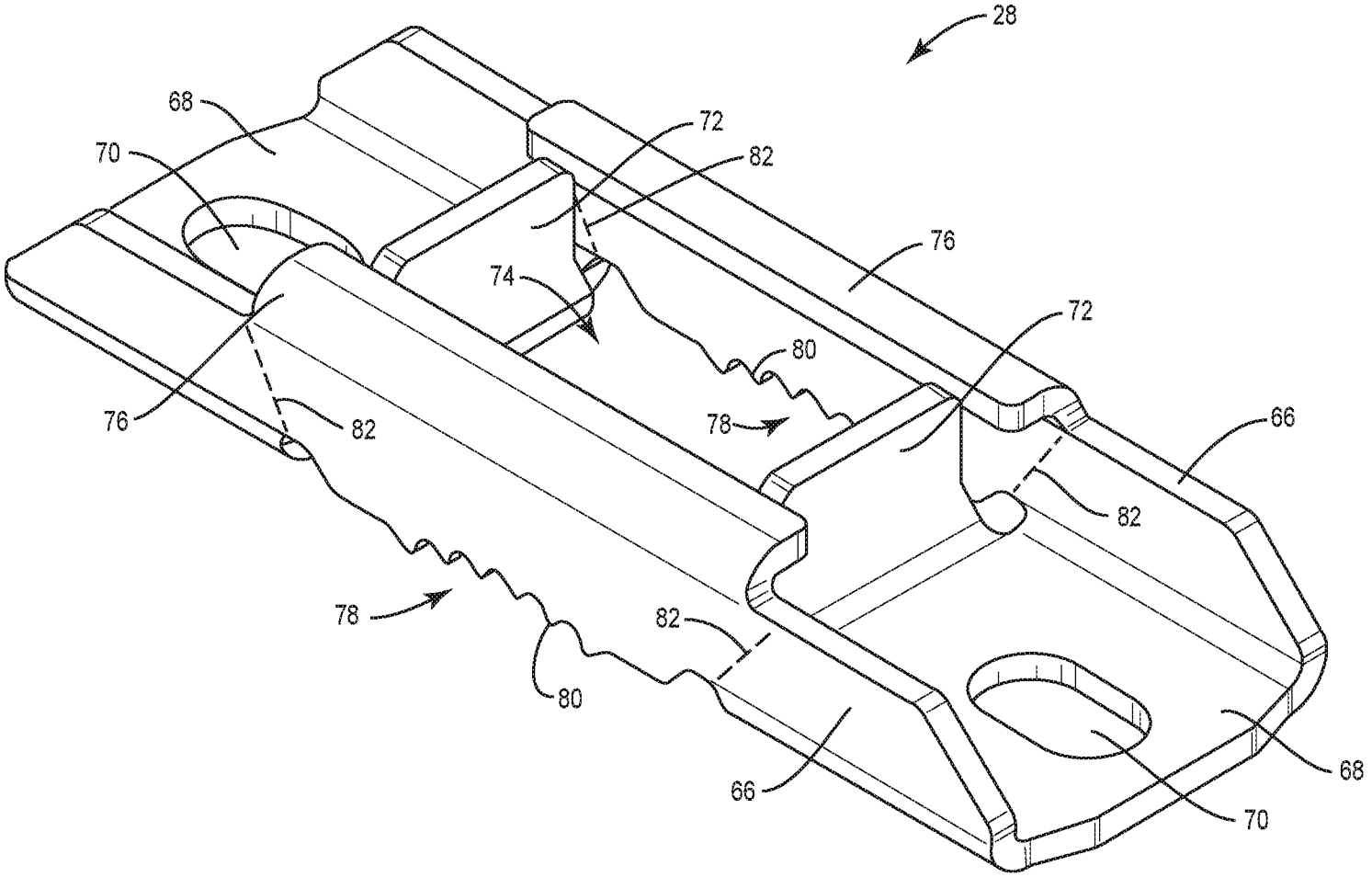
FIG. 16 is a top isometric view of a tenon bracket according to one embodiment.
Figure 17:
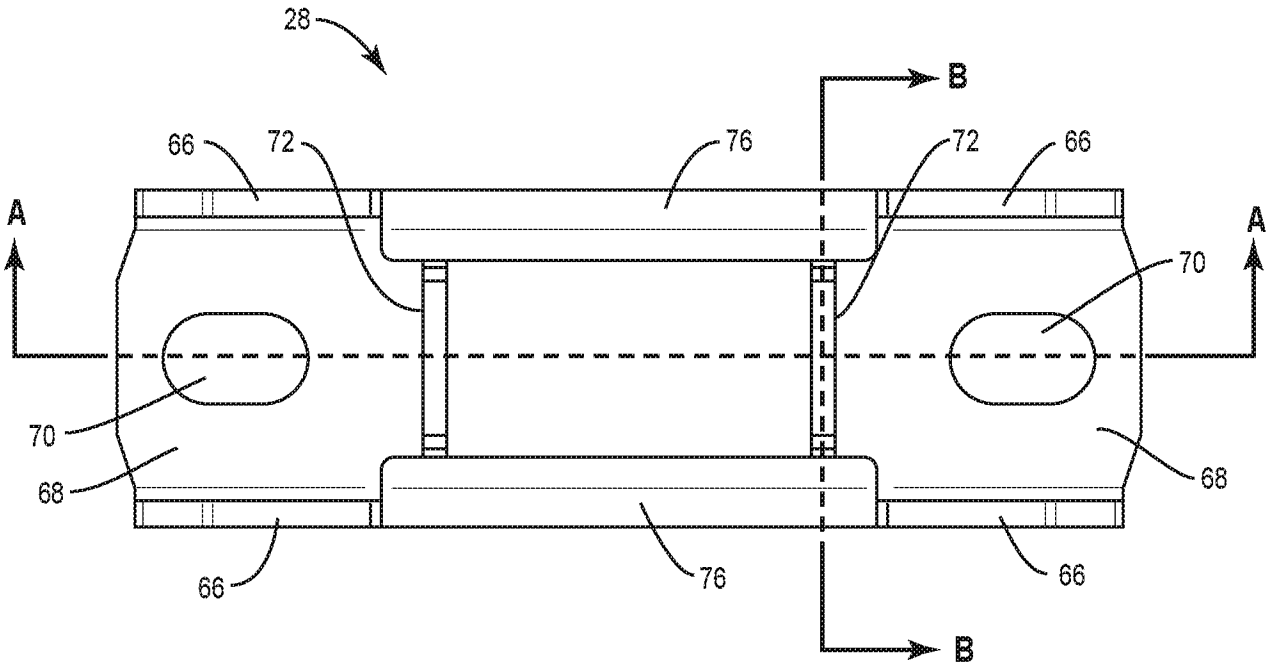
FIG. 17 is a top plan view of the tenon bracket of FIG. 16.
Figure 18:
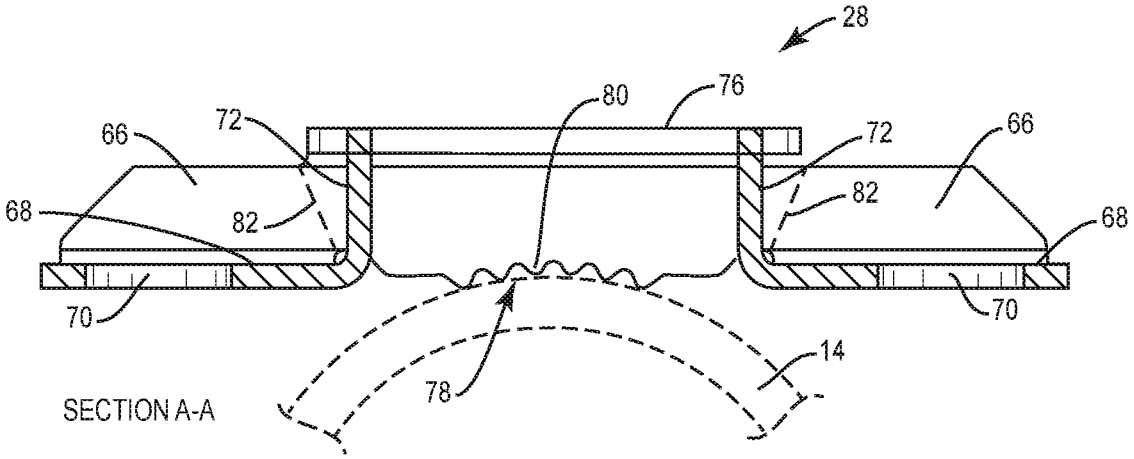
FIG. 18 is a first cross-sectional view of the tenon bracket of FIG. 16.
Figure 19:
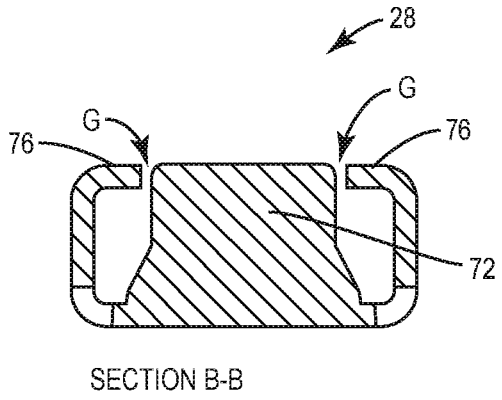
FIG. 19 is a second cross-sectional view of the tenon bracket of FIG. 16.

Referring generally to FIG. 10 and in particular to FIGS. 16-19, one embodiment of the cradle bracket 28 is described in detail. The cradle bracket 28 may be formed from various materials, including aluminum, steel, carbon reinforced polymers, and the like. FIG. 16 is a top isometric view of the cradle bracket 28. FIG. 17 is a top view of the cradle bracket 28, wherein FIGS. 18 and 19 are cross-sectional views A-A and B-B, as identified in FIG. 17. The cradle bracket 28 includes two parallel and vertically oriented sidewalls 66 and two wings 68, which span between the two sidewalls 66 on opposing ends of the cradle bracket 28. The wings 68 are biased toward the bottoms of the sidewalls 66 and each includes an elongated bolt hole 70 that receive the bolts 30 (not shown in FIG. 16). The bolt holes 70 are elongated along the length of the cradle bracket 28 and provide room for play for the bolts 30 as the cradle bracket 28 is tightened against the tenon 14.

With particular reference to FIGS. 16 and 19, an interior wall 72 extends vertically upward from an inside edge of each wing 68, such that an interior opening 74 is provided between the two interior walls 72 and within an interior portion of the cradle bracket 28. Notably, the opposing side edges of the interior walls 72 are spaced apart from the adjacent sidewalls 66. In this embodiment, the sidewalls 66 each have a wall extension 76 that effectively extends the sidewall 66 upward before curving inward toward the side edges of the interior wall 72. A gap G may be provided between the edges of the wall extension 76 and the adjacent edges of the interior walls 72. As the cradle bracket 28 is tightened against the tenon 14, the sidewalls 66 may deflect inward. If the sidewalls 66 deflect inward, the edges of the wall extension 76 will move inward and come into contact with the side edges of the interior walls 72. Once the edges of the wall extensions 76 contact the side edges of the interior wall 72, the inward deflection of the sidewalls 66 is substantially, if not completely, prohibited in an effort to maintain the structural integrity of the cradle bracket 28 while under load.

The cradle bracket 28 may also include two tenon interfaces 78, which reside centrally on the bottom of each of the two sidewalls 66. These tenon interfaces 78 are aligned with the interior opening 74 and are concave in nature, such that the concavity generally coincides with the outer radii of standard tenons 14. In such embodiments, the tenon cradle 26 may also be concave and coincident with the tenon 14. The tenon interfaces 78 may be covered with a gripping surface 80, such as the illustrated teeth or splines. However, the gripping surfaces 80 may take various forms and are intended to prevent the lighting fixture 10 from rotating about the tenon 14 after installation.

Figure 20:
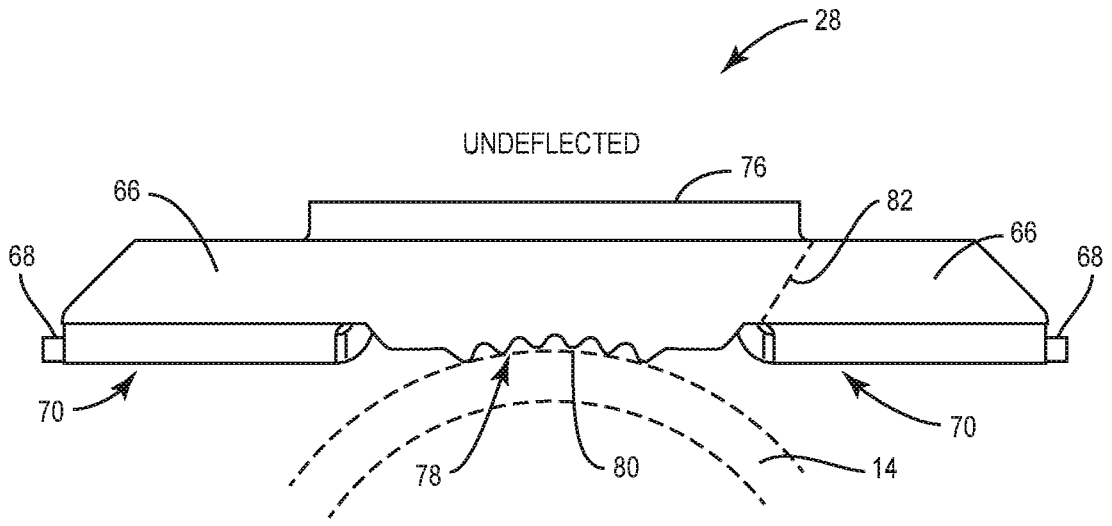
FIG. 20 is a side plan view of the tenon bracket of FIG. 16, wherein the wings of the tenon bracket are not deflected.
Figure 21:
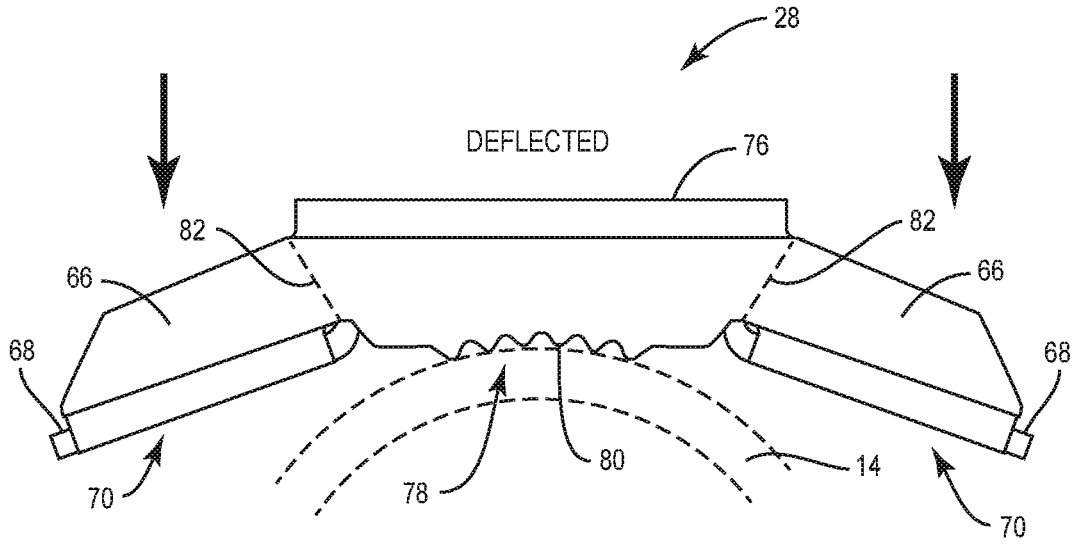
FIG. 21 is a side plan view of the tenon bracket of FIG. 16, wherein the wings of the tenon bracket are deflected.

Another potential feature of the cradle bracket 28 is the presence of preferential bending regions 82, which are formed in the sidewalls 66 near the interior edges of the wings 68. Preferential bending regions 82 effectively allow the wings 68, as well as the associated portions of the sidewalls 66, to deflect downward as the cradle bracket 28 is tightened against the tenon 14 with the bolts 30. FIG. 20 is a side view of an undeflected cradle bracket 28. FIG. 21 is a side view of a cradle bracket 28 that has been deflected in response to bolt forces associated with the cradle bracket 28 being tightened against the tenon 14. Notice that the wing 68 and the associated portions of the sidewall 66 are deflected downward, while a central portion of the cradle bracket 28 remains substantially intact, wherein the deflection point resides near or within the preferential bending regions 82, which may be implemented in any number of ways, as one skilled in the art will appreciate. In operation, using the interior walls 72 to prevent the sidewalls 66 from deflecting inward essentially ensures that the wing 68 will bend downward as the cradle bracket 28 is tightened against the tenon 14.

In the illustrated embodiment, the lack of a horizontal section, or floor, in the central portion of the cradle bracket 28 in combination with the curved wall extensions in the central portion of the cradle bracket 28 help define the preferential bending regions 82. As such, the illustrated preferential bending regions 82 reside in the sidewalls 66 and extend from an interior edge of the wings 68 to the ends of the wall extensions 76. The sidewalls 66 may also be thinned or cross-drilled to create or supplement the preferential bending regions 82. An alternate method is deviating from the planar surface by embossing a step or rib that initiates a hinge point to create a preferential bending region.

In one embodiment, the preferential bending regions 82 are designed to bend in a visibly perceptible manner upon being subjected to a defined amount of force. Deformation of the cradle bracket 28 provides a visual indication that the bolts 30 are sufficiently tight. Avoiding over-tightening the bolts 30 is important to avoid accidentally fracturing the housing 18. For example, the wings 68 may start to bend, albeit not to a visibly perceptible degree, at or above 200 in-lbs., 250 in-lbs., or 300 in-lbs., of torque with visible bending at 350 in-lbs, 400 in-lbs., or 450 in-lbs., of torque, inclusive of all combinations.

Figure 22:
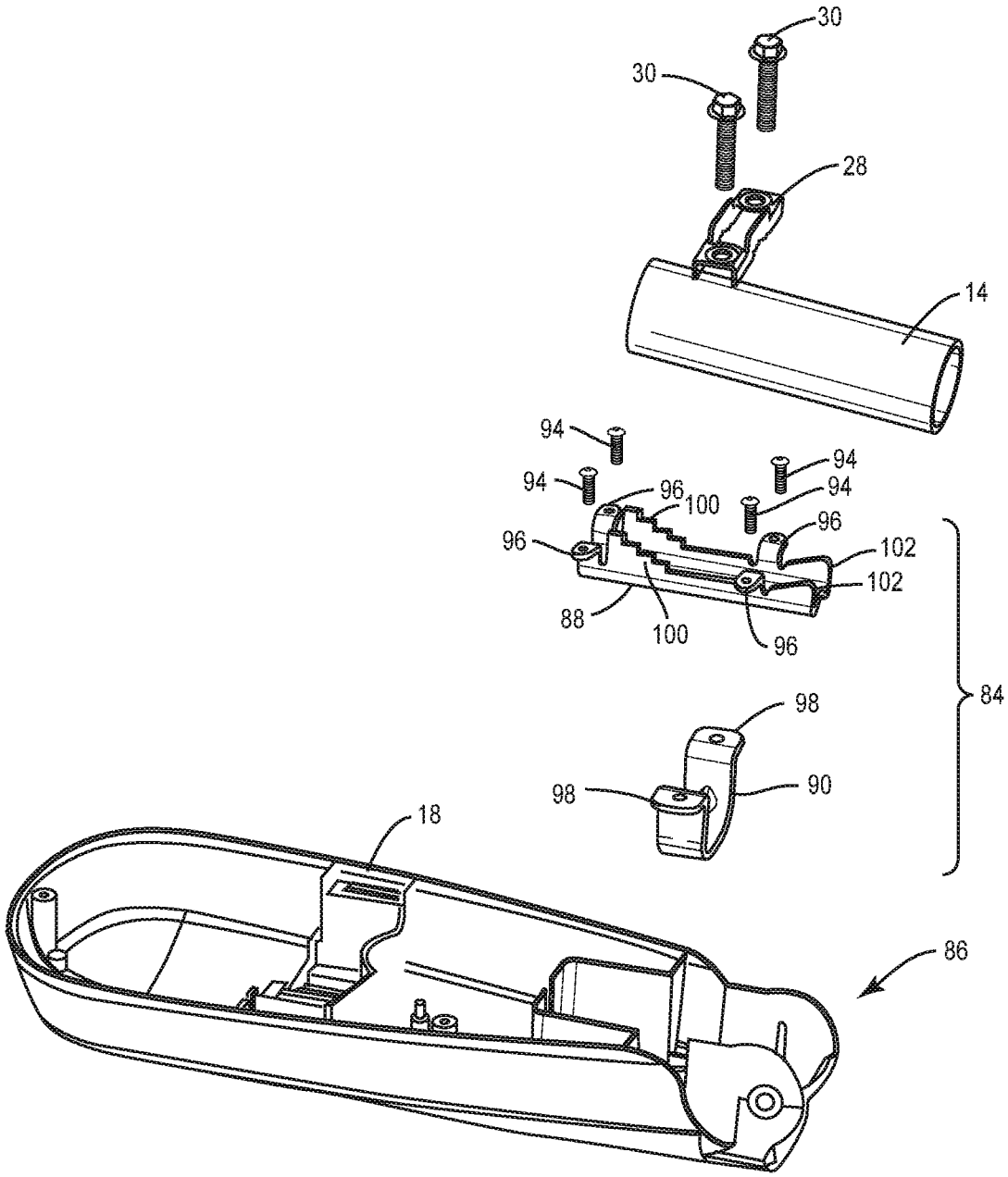
FIG. 22 is an exploded bottom-rear isometric view of a lighting fixture and alternative cradle assembly according to one embodiment.
Figure 23:
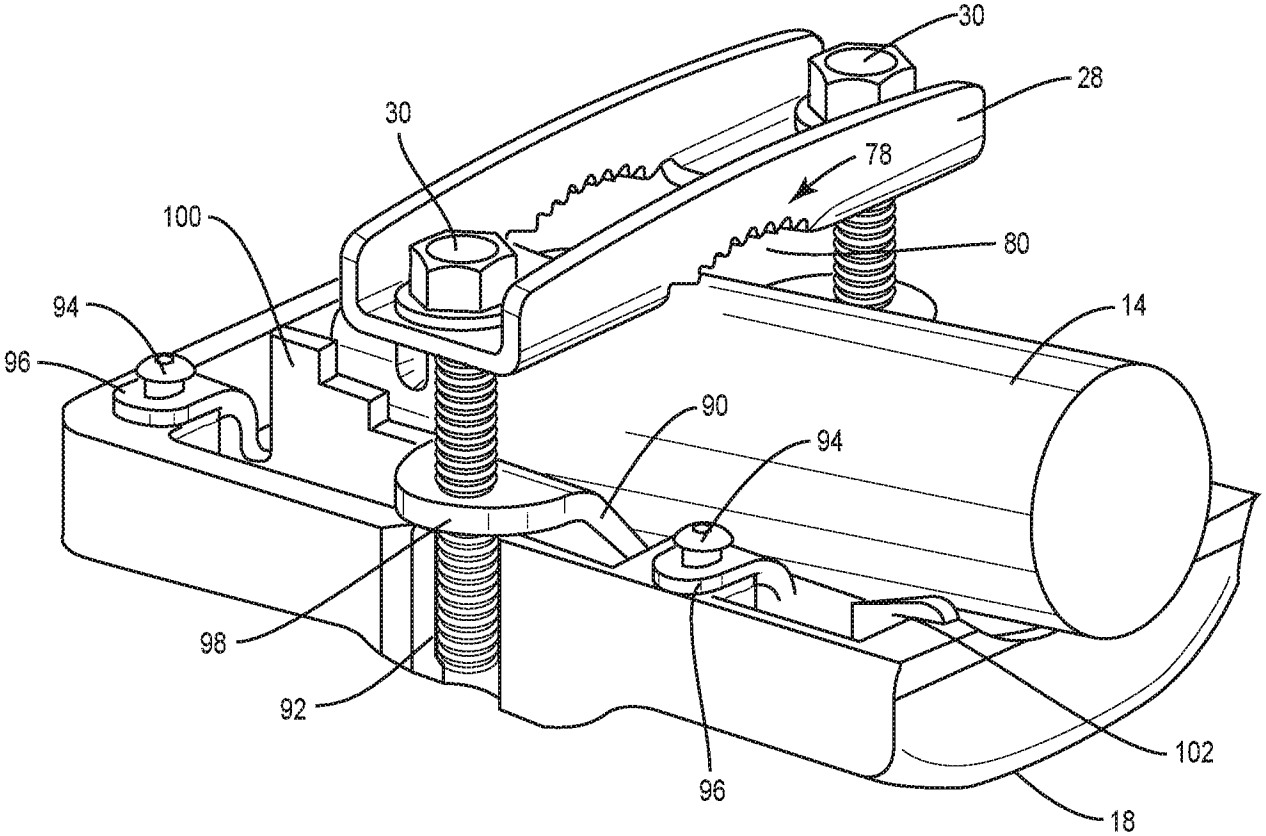
FIG. 23 is a bottom rear cross sectional housing cut-out isometric view of the alternative cradle assembly of FIG. 22, when installed in a receiving region of the housing of the lighting fixture.

FIGS. 22 through 27 illustrate alternative technique for attaching the tenon 14 in the lighting fixture 10. Instead of a tenon cradle 26 that is integrated into the rear of the housing 18, a separate cradle assembly 84 is provided, which may be formed from various materials, including aluminum, steel, carbon reinforced polymers, and the like. With particular reference to FIGS. 22 and 23, the cradle assembly 84 is bolted into a receiving region 86, which is integrally formed within the housing 18 of the lighting fixture 10. The exploded view of FIG. 22 illustrates an embodiment wherein the cradle assembly 84 includes a main cradle body 88 and a cross bracket 90. The cradle body 88 is bolted into housing bosses 92, as illustrated in FIG. 23, using body bolts 94. A more cost-effective solution may use molded-in threaded inserts, and conventional fasteners to fasten the cradle body 88 into the molded-in threaded inserts.

Figure 24:
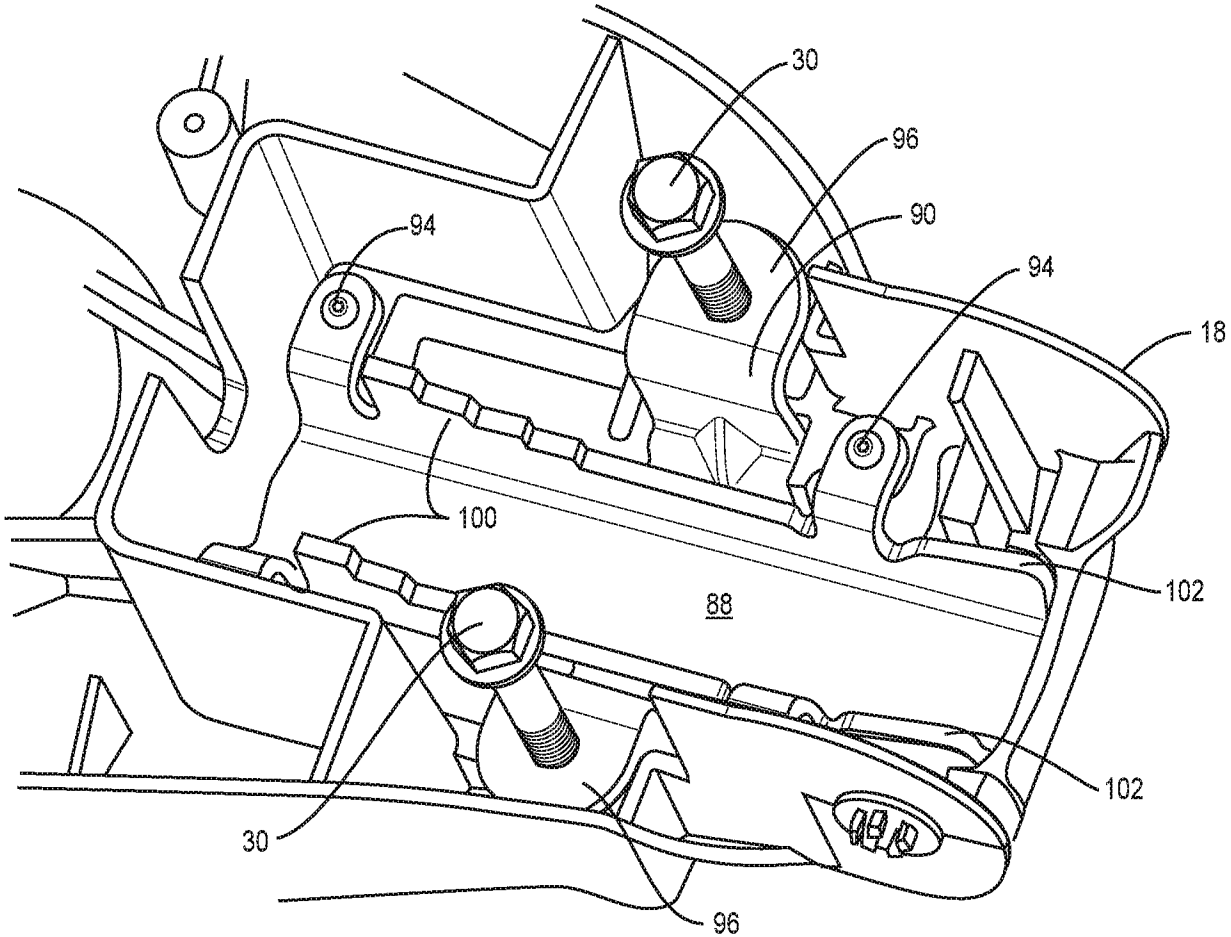
FIG. 24 is a bottom rear isometric view of the cradle body of the cradle assembly installed in a receiving region of the housing of the lighting fixture.

During assembly, a cross bracket 90 is positioned into the receiving region 86, and the cradle body 88 is bolted into place such that the cross bracket 90 is held in place by being captured between the cradle body 88 and the interior surface of the receiving region 86. Alternatively, the cross bracket 90 may be separately affixed to the interior of the receiving region 86. FIG. 24 illustrates the cradle assembly 84 installed in the receiving region 86 of the housing 18.

Returning to FIGS. 22 and 23, the cradle body 88 of the cradle assembly 84 includes a stepped structure similar to that described above, wherein pairs of steps 100 are provided at one end of the cradle body 88 and a pair of tenon supports 102 are provided at the opposite end of the cradle body 88. The steps 100 may have beveled surfaces and function like the outer pole platforms 48 of the above embodiment, wherein the end of the tenon 14 will rest on a selected step that is chosen such that the lighting fixture 10 is mounted in the most level position. At the rear of the cradle body 88, the tenon 14 will rest on the opposing tenon supports 102.

Figure 25:
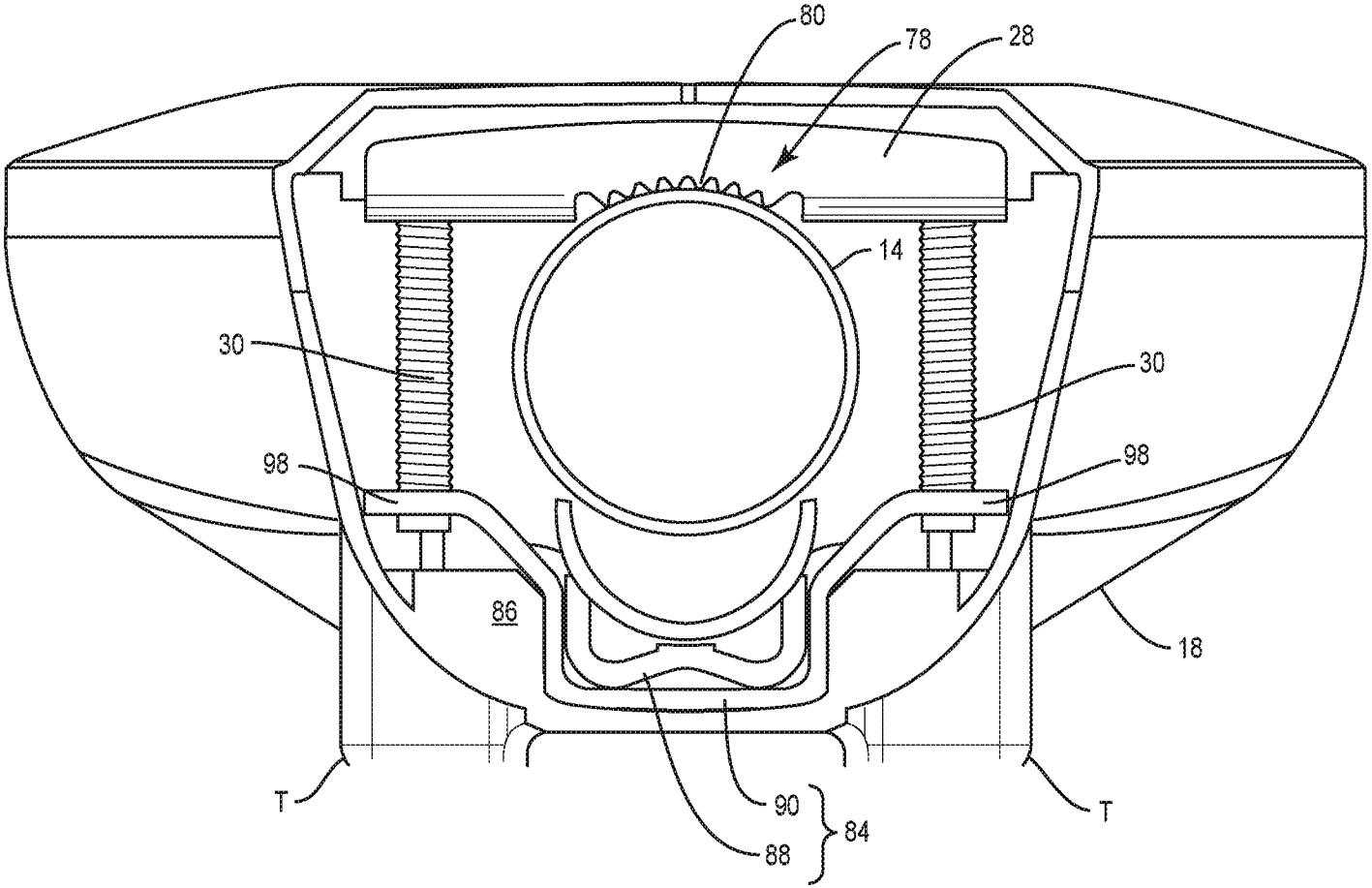
FIG. 25 is a cross-sectional view of a housing of the lighting fixture with the alternative cradle assembly.

With reference to FIGS. 23 and 25, the tenon 14 is held in place against the cradle body 88 of the cradle assembly 84 with the cradle bracket 28 and bolts 30. The bolts 30 extend through the cradle bracket 28 and are threaded into holes provided in cross bracket mounting ears 98 of the cross bracket 90. As illustrated, the gripping surface 80 of the tenon interface 78 for the cradle bracket 28 engages the tenon 14 to securely affix the lighting fixture 10 to the tenon 14. In some instances of fixture installation, the cradle bracket 28 will sit closer to the cradle assembly 84 due to a change in step position and reduced pole size. In this condition, the housing 18 includes additional space, or 'bolt extension,' for the bolts to protrude into the top of the housing 18, without prematurely bottoming out before achieving an acceptable install clamp force on the tenon 14. Enclosing this area of the 'bolt extension' reduces the likelihood for water-related shortages due to splashing on the internal electronics and terminal blocks relative to embodiments where these areas are not completely enclosed. This is the driving factor behind the 'small turrets' T on the rear end of the housing, as illustrated in FIG. 25. The particular aesthetic form of this feature can vary, so long as it fully encloses the bolts 30 and their entire range of motion throughout the different variations of installs.

Figure 26:
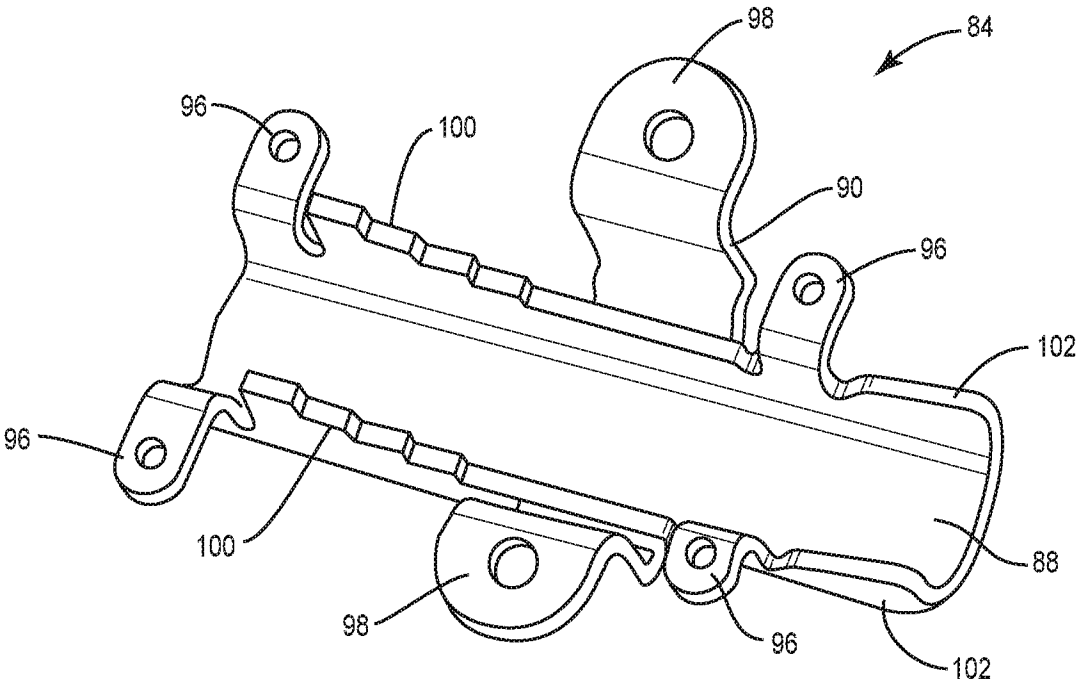
FIG. 26 is an isometric view of the cradle body of FIG. 24.
Figure 27:
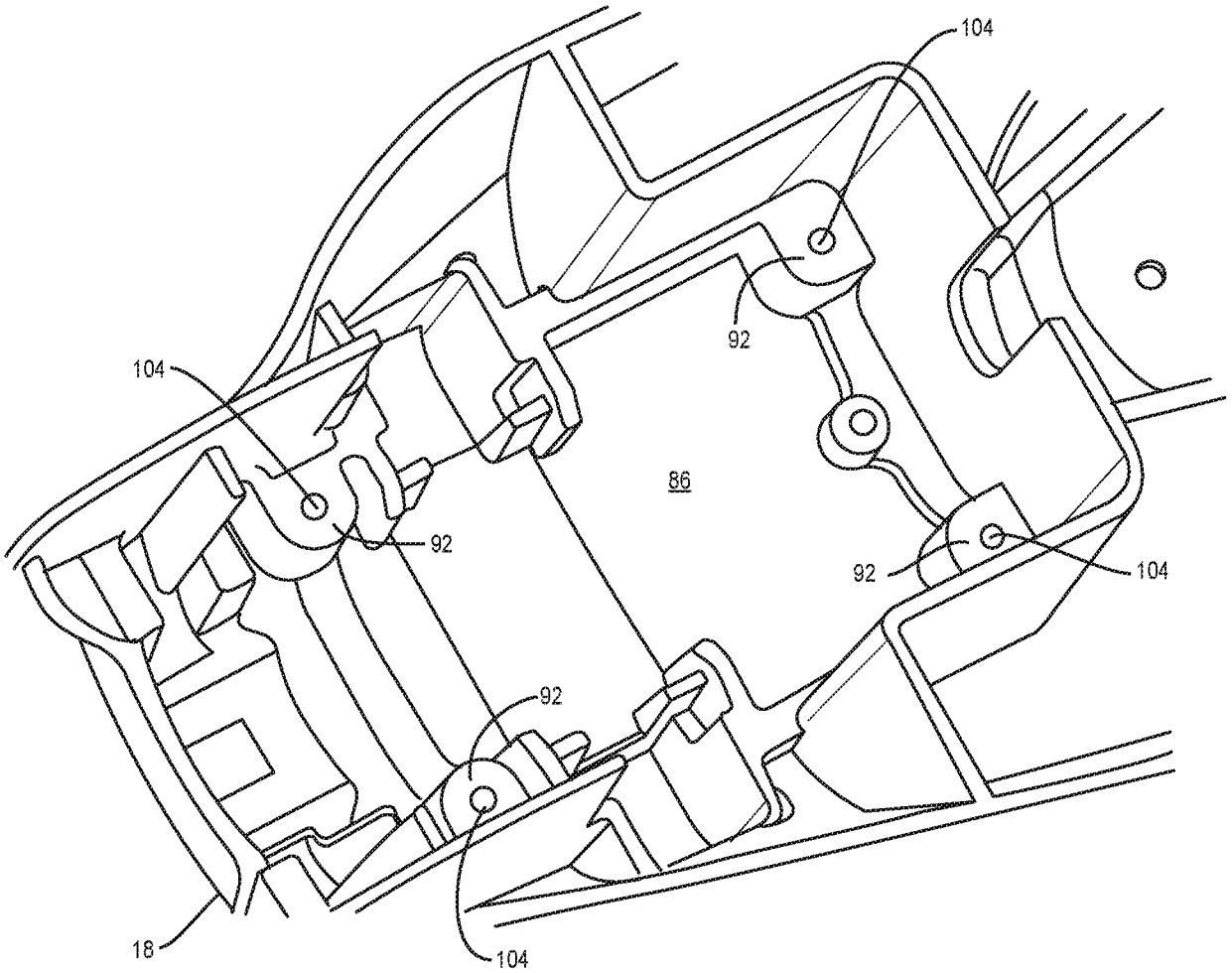
FIG. 27 is a bottom-rear isometric view of the receiving region of the housing of the lighting fixture of FIG. 22.

FIGS. 26 and 27 respectively illustrate the cradle assembly 84 in isolation and the receiving region 86 without the cradle assembly 84 of the housing 18. In FIG. 27, the housing bosses 92 are clearly visible. The body bolts 94 are threaded into molded-in and threaded inserts in the boss holes 104 of the housing bosses 92 to attach the cradle assembly 84, and in particular the cradle body 88, to the receiving region 86 of the housing 18. For this embodiment, the housing 18 is not subjected to forces associated with affixing the cradle assembly 84 to the tenon 14. As such, over-tightening of the cradle bracket 28 will have little or no impact on the housing 18. If over-tightening occurs, the U-shaped body of the cross bracket 90 may simply bend about the tenon 14; however, since the cross bracket 90 is not directly affixed to the housing 18, such bending will damage neither the housing 18 nor the cradle body 88.

Figure 29:
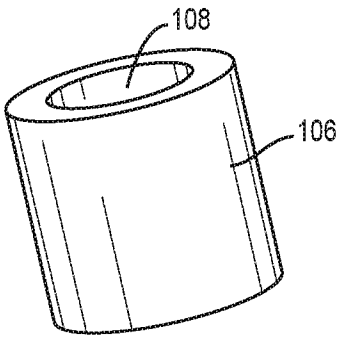
FIG. 29 illustrates a bolt boss employed in the housing of FIG. 28.
Figure 28:
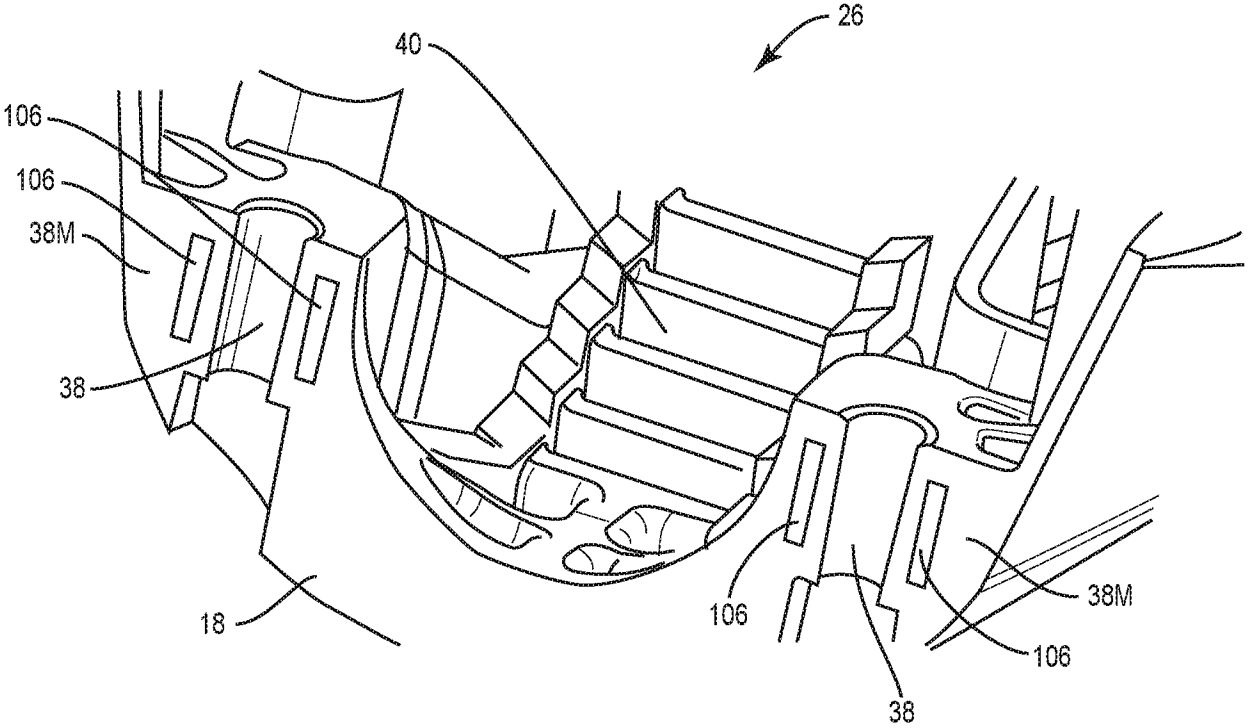
FIG. 28 is a sectional view of a housing of a lighting fixture that incorporates reinforcing tubes in bolt bosses of the housing.

Turning now to FIGS. 28 and 29, another technique for reinforcing the housing 18 is provided. In this embodiment, reinforcing tubes 106 are formed in the bolt bosses 38M. The reinforcing tubes 106 are positioned such that the bolt shafts 38 extend through the interior 108 of the reinforcing tubes 106. The mold compound or other material used to form the housing 18 may fully encompass the reinforcing tubes 106 such that the interior surfaces of the bolt shafts 38 are formed from the mold compound. While the annular wall of each reinforcing tube 106 is shown as being solid, they may be perforated in a variety of ways. In one embodiment, the reinforcing tubes 106 are formed from various materials, including aluminum, steel, carbon reinforced polymers, and the like. The advantage of this reinforcement is to counter the natural failure mode of the force balance applied to the tenon 14. The tenon 14 contacting the stepped structure 40 at the end and edge of the housing 18 applies a force in one direction. The bolts 30 engaged in the nuts apply the opposing force to the housing 18 in between the two tenon contact locations. The resulting stress in the housing 18 is working to break it at the plane of the bolts 30. The two bolt shafts penetrating the housing 18 create a weakening effect at this high stress plane. The reinforcing tubes 106 provide extra strength to prevent the housing from splitting at the two bolt shafts 38.

Figure 30:
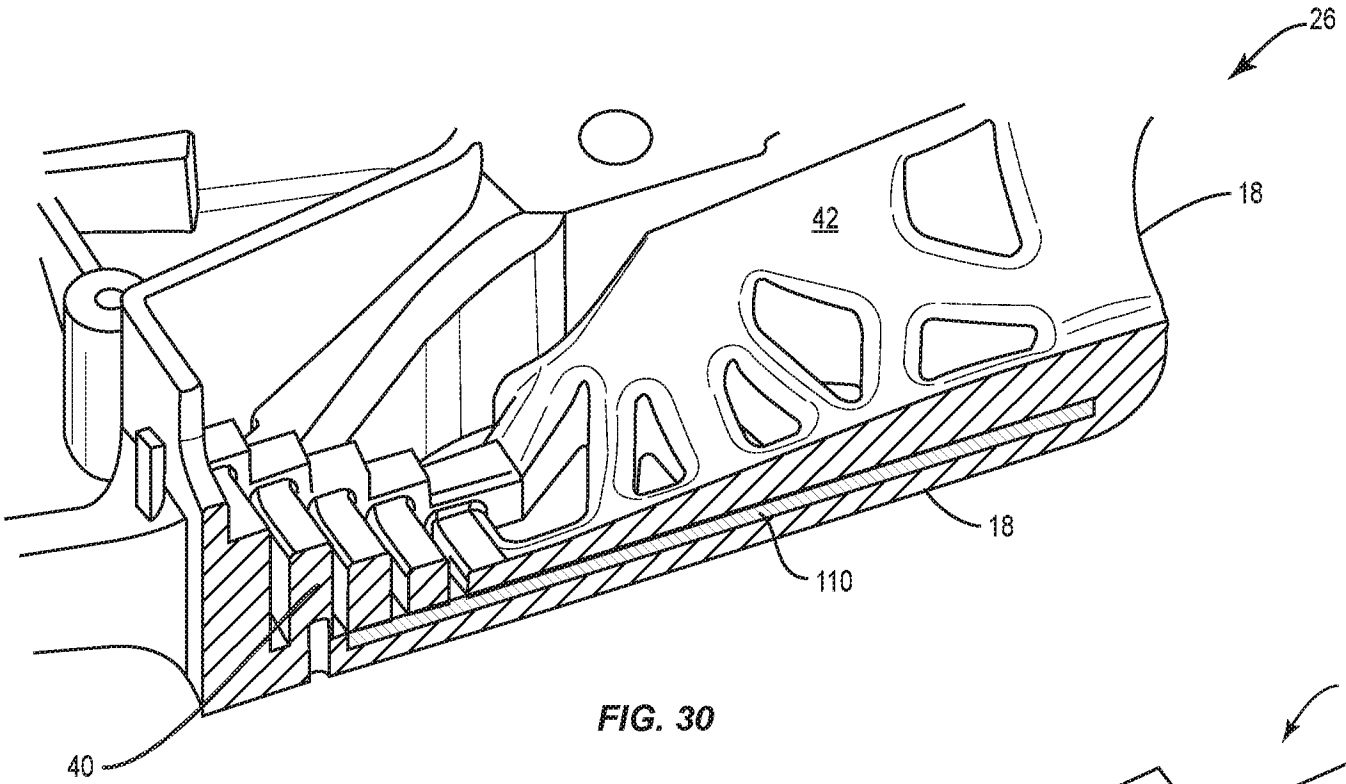
FIG. 30 is a sectional view of a housing of a lighting fixture that incorporates a reinforcement insert in the tenon cradle.
Figure 31:
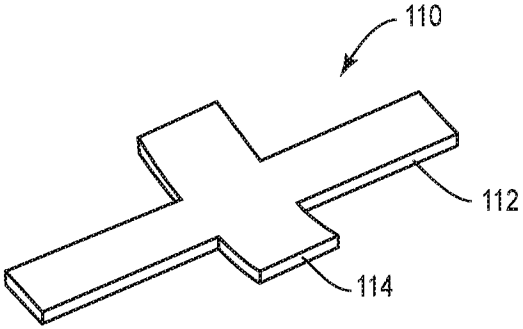
FIG. 31 is a reinforcement insert according to a first embodiment.
Figure 32:
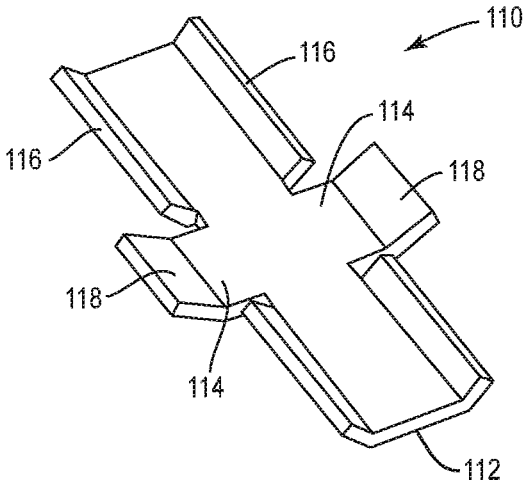
FIG. 32 is a reinforcement insert according to a second embodiment.
Figure 33:
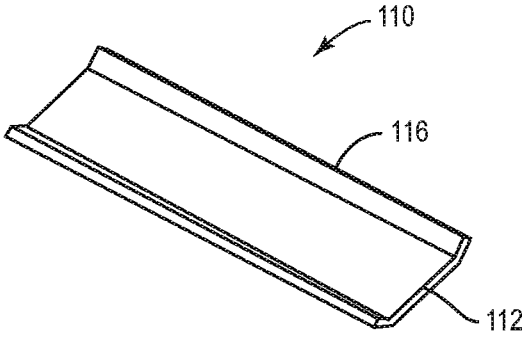
FIG. 33 is a reinforcement insert according to a third embodiment.

FIGS. 30 and 31 illustrate the concept of employing an internal reinforcement bracket 110, which is integrally formed in the housing 18 above and behind the stepped structure 40 and the rib structure 42 of the tenon cradle 26. FIG. 30 shows a cross-section of the housing 18 with the reinforcement bracket 110 in place. Notably, the reinforcement bracket 110 is substantially surrounded by the mold compound or other material used to form the housing 18, but may be exposed by the voids between the various ribs of the rib structure 42. FIG. 31 illustrates a first embodiment of the reinforcement bracket 110 that includes a flat backbone 112 and a pair of wings 114 extended opposite directions from the backbone 112. FIG. 32 illustrates a second embodiment of the reinforcement bracket 110 wherein the sides of the backbone 112 and the ends of the wings 114 include angled sidewalls 116 and 118, respectively. The sidewalls 116 and 118 may contour according to the shape of the housing 18 as well as provide additional structural integrity. FIG. 33 illustrates a third embodiment of the reinforcement bracket 110, which only includes a backbone 112 and opposing angled sidewalls 116.

Figure 34:
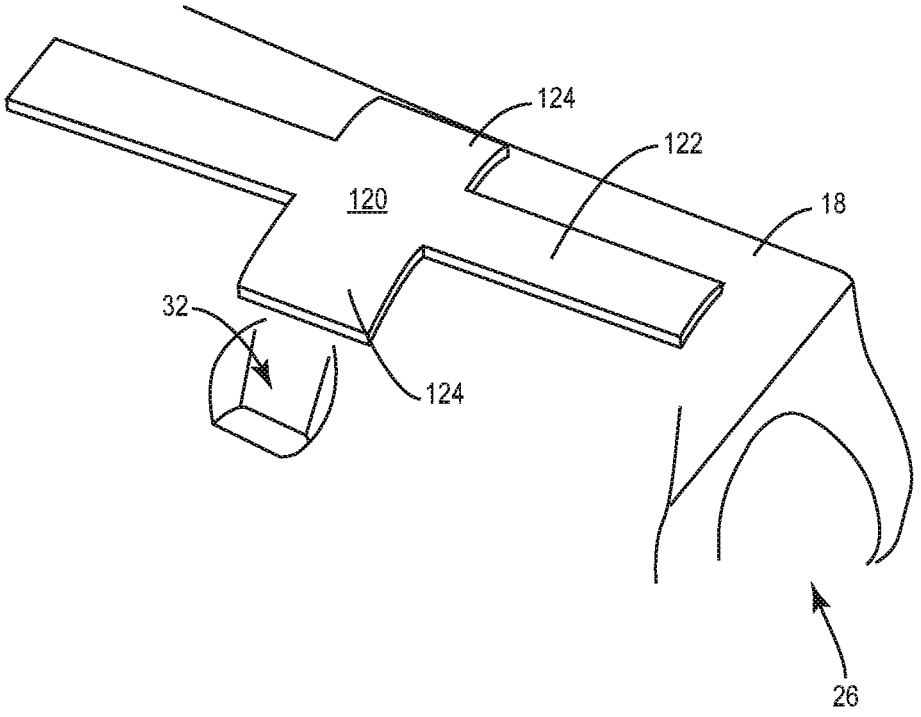
FIG. 34 is a top rear isometric view of the housing of the lighting fixture that incorporates an external reinforcement member according to one embodiment.

With reference to FIG. 34, a reinforcement bracket 120 is illustrated. The reinforcement bracket 120 mounts on the outside surface of the housing 18 and may take various shapes. As illustrated, the reinforcement bracket 120 includes an elongated backbone 122 and a pair of wings 124 that extend in opposite directions from the backbone 122. The reinforcement bracket 120 may be contoured to match the contour of the outer surface of the housing 18. The reinforcement brackets 110 and 120 may be formed from various materials, including aluminum, steel, carbon reinforced polymers, and the like.

The various concepts disclosed above are summarized as follows. Increasing the size of the landing area 36 for the weld nuts 34 helps distribute 'nut pull-out forces' over a larger area and thus reduce the likelihood of the weld nuts 34 pulling out when the bolt 30 is over-tightened. Incorporating thicker ribbing in the tenon cradle 26 aids the flow of mold compound during fabrication of the housing 18 and helps ensure that glass fibers are in a preferred orientation for optimal structural integrity. Thicker ribbing also increases the ability of the housing 18 to withstand force loads that are presented along the ribs. Further, orienting the ribbing in the direction of the forces acting on the housing 18 improves rigidity and focuses support where support is required.

Incorporating the axial channel 56 in the rear of the tenon cradle 26 halves what would be a 'point force loading' condition and reduces the likelihood of the housing 18 to split down the rear. The axial channel 56 also improves tenon alignment during installation, and reduces the mounting force required to pass lifetime vibe requirements. Increasing the length of the bolt boss 38M, and thus bolt shaft 38 provides several benefits. The first benefit is reducing the likelihood of nut pull-out given the increased amount of material required to fracture. The second is reducing the amount of bolt movement, which tends to improve the distribution of forces across the bolt boss 38M.

Rounding out the rear of housing 18 prevents accumulation of stress on sharp corners and indentation features. Rounding out the tenon cradle 26 to match large pole diameter in 'lowest step condition' (with some clearance for tolerance) allows one to maximize the amount of material available for additional strengthening. Incorporating different higher and lower angled surfaces 52, 54 at the rear of the housing 18 helps to distribute forces across a larger area, regardless of on which step 44 the tenon 14 rests.

Using the elongated weld nuts 34, although other types of nuts may be used, in an orientation such that the long portion of the weld nuts 34 are in a direction parallel with the long portion of the housing 18 increases the amount of material available to resist pull-through forces.

Incorporating a cradle bracket (28) design that provides visual feedback through bending or deflection when sufficient torque has been applied will reduce the tendency for installers to overtighten the bolts 30. Incorporating a strip out feature in the weld nuts 34 provides further protection against installer over-tightening.

Those skilled in the art will recognize improvements and modifications to the preferred embodiments of the present disclosure. All such improvements and modifications are considered within the scope of the concepts disclosed herein and the claims that follow.

What is claimed is:

1. An outdoor lighting fixture comprising:

a light source;

a housing comprising a receiving region in communication with a rear opening of the housing and configured to receive a tenon of a light pole; and a cradle assembly attached to the receiving region of the housing, the cradle assembly comprising a cradle body with a stepped structure forming a plurality of platforms configured to receive an end of the tenon of the light pole at a selected one of a plurality of different levels.

2. The outdoor lighting fixture of claim 1, wherein the cradle body further comprises tenon supports at an end of the cradle body.

3. The outdoor lighting fixture of claim 1, wherein the plurality of platforms are beveled inward within the cradle body.

4. The outdoor lighting fixture of claim 1, wherein the cradle assembly further comprises a cross bracket that is positioned between the cradle body and the receiving region of the housing.

5. The outdoor lighting fixture of claim 4, wherein the cradle assembly is attached to the receiving region of the housing such that the cross bracket is held in place.

6. The outdoor lighting fixture of claim 4, further comprising a cradle bracket that is fixed to the cross bracket such that the tenon is positioned between the cradle bracket and the cross bracket.

7. The outdoor lighting fixture of claim 6, wherein the cradle bracket comprises a first wing, a second wing, and a tenon interface between the first wing and the second wing, the tenon interface configured to engage the tenon when the tenon is within the cradle assembly.

8. The outdoor lighting fixture of claim 7, wherein the cradle bracket is bolted to the cross bracket by a first bolt that extends through the first wing and a second bolt that extends through the second wing.

9. The outdoor lighting fixture of claim 8, wherein the cross bracket is configured to bend about the tenon.

10. The outdoor lighting fixture of claim 8, wherein the housing forms one or more turrets configured to receive the first bolt and the second bolt.

11. The outdoor lighting fixture of claim 7, wherein the cradle bracket further comprises opposing sidewalls such that the first wing and the second wing reside between the opposing sidewalls, and the tenon interface is provided by arcuate recesses in a bottom of the opposing sidewalls.

12. The outdoor lighting fixture of claim 11, wherein the tenon interface is concave at the bottom of the opposing sidewalls.

13. The outdoor lighting fixture of claim 7, wherein the tenon interface comprises a gripping surface.

14. The outdoor lighting fixture of claim 7, wherein the tenon interface comprises at least one of teeth or splines.

15. A cradle assembly for a lighting fixture, the cradle assembly comprising:

a cradle body comprising a stepped structure forming a plurality of platforms configured to receive an end of a tenon at a selected one of a plurality of different levels; and a cross bracket that is configured to receive one or more bolts to secure the tenon to the cradle body.

16. The cradle assembly of claim 15, wherein the cradle body further comprises tenon supports.

17. The cradle assembly of claim 16, wherein the tenon supports are arranged on an opposite end of the cradle body than the stepped structure.

18. The cradle assembly of claim 15, wherein the plurality of platforms are beveled inward within the cradle body.

19. The cradle assembly of claim 15, wherein the cross bracket is further configured to bend about the tenon.

20. The cradle assembly of claim 15, wherein the cross bracket forms a U-shape about portions of the cradle body.

* * * * *